US011635280B2

(12) United States Patent
Chen

(10) Patent No.: US 11,635,280 B2
(45) Date of Patent: Apr. 25, 2023

(54) PROTECTIVE SHIELD, SHIELD WALL AND SHIELD WALL ASSEMBLY

(71) Applicant: Graphene Composites Limited, Stockton-on-Tees (GB)

(72) Inventor: Sandy Winthrop Chen, Balcombe (GB)

(73) Assignee: Graphene Composites Limited, Stockton-on-Tees (GB)

( * ) Notice: Subject to any disclaimer, the term of this patent is extended or adjusted under 35 U.S.C. 154(b) by 0 days.

(21) Appl. No.: 17/056,246

(22) PCT Filed: Jan. 18, 2019

(86) PCT No.: PCT/GB2019/050147
§ 371 (c)(1),
(2) Date: Nov. 17, 2020

(87) PCT Pub. No.: WO2019/220070
PCT Pub. Date: Nov. 21, 2019

(65) Prior Publication Data

US 2021/0215459 A1 Jul. 15, 2021

(30) Foreign Application Priority Data

May 18, 2018 (GB) ..... 1808119

(51) Int. Cl.
*F41H 5/013* (2006.01)
*F41H 5/04* (2006.01)
*F41H 5/08* (2006.01)

(52) U.S. Cl.
CPC ..... *F41H 5/013* (2013.01); *F41H 5/0492* (2013.01); *F41H 5/08* (2013.01)

(58) Field of Classification Search
CPC ..... F41H 5/013; F41H 5/0492; F41H 5/08; F41H 5/0485; F41H 5/33
See application file for complete search history.

(56) References Cited

U.S. PATENT DOCUMENTS 4,830,245 A 5/1989 Arakaki
4,843,947 A 7/1989 Bauer et al.
(Continued)

FOREIGN PATENT DOCUMENTS

CA 2205435 11/1998
CN 101 839 674 A 9/2010
(Continued)

OTHER PUBLICATIONS

PCT/GB2019/050147; International Search Report and Written Opinion; dated Aug. 1, 2019; 18 pages.
(Continued)

*Primary Examiner* — Joshua E Freeman
(74) *Attorney, Agent, or Firm* — Kilpatrick Townsend & Stockton LLP

(57) ABSTRACT

A protective shield (100) comprises a body (105) for protecting a user from a projectile or impact, the body comprising a front strike face (110) and an opposing rear face (115); and a connector arrangement (125, 126) provided on the body adapted so as to allow the shield to connect to an adjacent protective shield, wherein the strike face has a perimeter defined by the edges of the strike face; and wherein the connector arrangement is arranged so that an adjacent protective shield can be connected to the connector arrangement with the body of the adjacent protective shield abutting and/or overlapping with the strike face of the protective shield at any point about the perimeter of the strike face.

14 Claims, 11 Drawing Sheets

(56) References Cited

U.S. PATENT DOCUMENTS

| | | | | |
|---|---|---|---|---|
| 5,377,577 | A * | 1/1995 | Bounkong | F41H 5/08 2/2.5 |
| 8,418,595 | B1 | 4/2013 | Saucedo | |
| 2005/0085146 | A1 | 4/2005 | Farkas et al. | |
| 2007/0180982 | A1 | 8/2007 | Dagher et al. | |
| 2011/0097021 | A1 | 4/2011 | Curran et al. | |
| 2012/0128983 | A1 | 5/2012 | Yoon et al. | |
| 2012/0189782 | A1 | 7/2012 | Zafiropoulos et al. | |
| 2013/0215551 | A1* | 8/2013 | Bowers | H05K 1/032 361/301.1 |
| 2014/0127490 | A1 | 5/2014 | Islam et al. | |
| 2014/0208932 | A1 | 7/2014 | Lee | |
| 2014/0240921 | A1 | 8/2014 | Sultenfuss et al. | |
| 2014/0260937 | A1* | 9/2014 | Whitaker | F41H 5/0478 89/36.02 |
| 2014/0287641 | A1* | 9/2014 | Steiner, III | F41H 5/0471 428/317.1 |
| 2015/0001966 | A1 | 1/2015 | Mccowen | |
| 2015/0192393 | A1 | 7/2015 | Yakoub | |
| 2015/0218730 | A1 | 8/2015 | Dang et al. | |
| 2015/0260329 | A1 | 9/2015 | Bond et al. | |
| 2016/0276056 | A1 | 9/2016 | Stolyarov et al. | |
| 2017/0013948 | A1 | 1/2017 | Duthoit | |
| 2017/0028674 | A1 | 2/2017 | Wadley et al. | |
| 2017/0218141 | A1* | 8/2017 | Nosker | C01B 32/225 |
| 2017/0307339 | A1* | 10/2017 | Bahu | F41H 5/08 |
| 2018/0022061 | A1 | 1/2018 | Kotake et al. | |
| 2018/0073841 | A1 | 3/2018 | DeKort | |
| 2018/0304598 | A1* | 10/2018 | Drzal | F41H 1/08 |
| 2022/0081808 | A1 | 3/2022 | Craig | |

FOREIGN PATENT DOCUMENTS

| | | | |
|---|---|---|---|
| CN | 102015282 | A | 4/2011 |
| CN | 103123830 | | 5/2013 |
| CN | 104848748 | | 8/2016 |
| CN | 106626676 | | 5/2017 |
| CN | 107097478 | | 8/2017 |
| CN | 107142037 | | 9/2017 |
| CN | 107225771 | A | 10/2017 |
| CN | 206575941 | | 10/2017 |
| CN | 107365497 | | 11/2017 |
| CN | 107513168 | | 12/2017 |
| DE | 420552 | | 10/1925 |
| DE | 2451315 | | 5/1976 |
| DE | 2713553 | | 10/1978 |
| DE | 198 05 638 | A1 | 8/1999 |
| GB | 2463454 | A | 3/2010 |
| KR | 20130034473 | | 4/2013 |
| KR | 20140039493 | | 4/2014 |
| WO | 2004018919 | | 3/2004 |
| WO | 2006009921 | | 1/2006 |
| WO | 2009/131727 | A2 | 10/2009 |
| WO | 2011024011 | | 3/2011 |
| WO | 2012138803 | | 10/2012 |
| WO | 2013148843 | | 10/2013 |
| WO | 2014/011108 | A1 | 1/2014 |
| WO | 2014197082 | | 12/2014 |
| WO | 2015160822 | | 10/2015 |
| WO | 2016015467 | | 2/2016 |
| WO | 2016/167714 | A1 | 10/2016 |
| WO | 2017014821 | A2 | 1/2017 |
| WO | 2017017628 | | 2/2017 |
| WO | 2017/123522 | A1 | 7/2017 |

OTHER PUBLICATIONS

U.S. Appl. No. 16/488,174 , Non-Final Office Action, dated May 2, 2022, 16 pages.

U.S. Appl. No. 16/488,174 , Non-Final Office Action, dated Oct. 25, 2021, 9 pages.

Application No. CN201980027668.6 , Office Action, dated Apr. 14, 2022, 16 pages.

Application No. CN201980040244.3 , Office Action, dated Jul. 13, 2022, 14 pages.

* cited by examiner

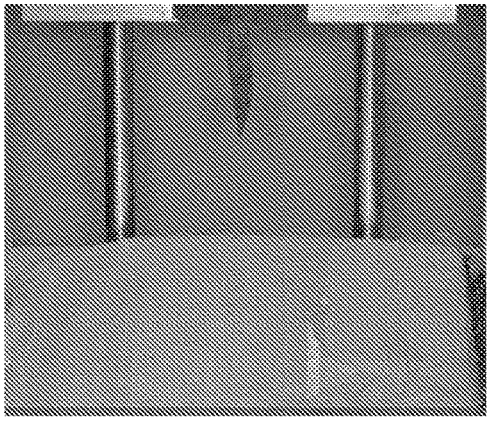
Figure 11a
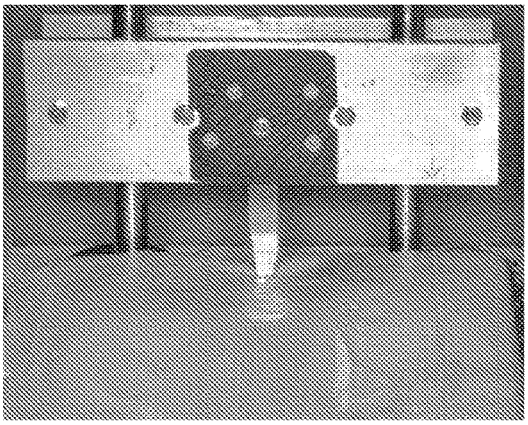
Figure 11b
Figure 12a
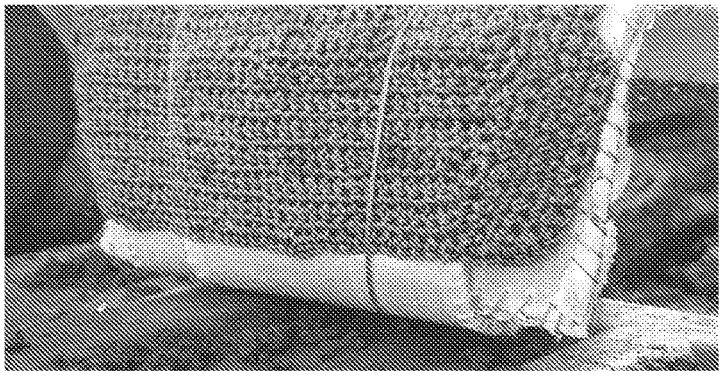
Figure 12b
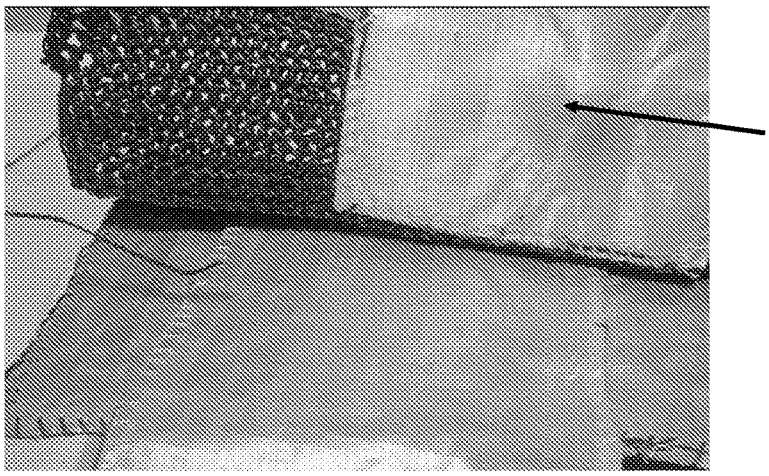

PROTECTIVE SHIELD, SHIELD WALL AND SHIELD WALL ASSEMBLY

FIELD OF INVENTION

The present invention relates to a protective shield, a shield wall and a deployable shield wall assembly.

BACKGROUND TO THE INVENTION

Articles such as bullet-proof or stab-proof vests are designed to protect a wearer or an object surrounded by the articles from an impact (e.g. from a projectile or blunt force) or from penetration (e.g. from a sharp object or bullet). However, in order to protect a user, a user must be wearing or carrying these articles at all times, which can be onerous particularly where the article is bulky or uncomfortable (e.g. in the case of a vest) or heavy. Thus, often users will forgo protection for comfort. Users also may not be comfortable wearing a vest or similar protection in particular social situations, for example at work or at a social event and, therefore, compliance is reduced. Moreover, while vests can be effective when an impact or projectile hits the chest or back of a user, they can leave the user exposed around other parts of the body, for example on the head or limbs. This can be a particular risk when the source of the impact is near to the user or object; for example, where the force is from a handheld weapon, such as a knife or a blunt force, and/or where the source of the projectile (e.g. a bullet) is at close range. Any protection that does cover these higher risk areas results in more inconvenience (e.g. in respect of mobility) and is not practical for day-to-day protection in lower risk situations. Bullet-proof or stab-proof vests are also limited in that they are only designed to protect a single person and cannot easily be used to protect more than one individual. Thus, during an event requiring the use of such a vest, there need to be sufficient vests for each individual, otherwise there will be insufficient protection. Therefore, it would be advantageous to provide protection that does not have these drawbacks.

Articles such as those mentioned above usually comprise a strike face and a rear face, with materials arranged in a particular order between the strike face and rear face. Typical materials used in body armour include carbon-based fibres, such as para aramid fibres, glass laminates, some polymers and/or metals or alloys. In some cases, the materials are provided in the form of composites or laminate structures, which are designed with particular properties in mind. Often, articles designed for penetration resistance (from edged weapons (e.g. bladed articles), for example) also include additional penetration resistant layers, such as a metal plate or chainmail, but these can be heavy, cumbersome and offer low protection against ballistics and, therefore, do not assist in encouraging a user to wear or otherwise use the articles.

It would be advantageous to provide a means of protecting a user that does not have these shortfalls. Moreover, it would be beneficial to provide protection that can be used to protect multiple users and which can quickly and easily be deployed.

Similarly, other non-wearable protective articles suffer from similar issues. For example, walls/shields may be provided that are intended to minimise the threat of projectiles or impacts, including barricades. These can be permanent installations or temporary. In both cases, where threats can evolve quickly, the ease and speed of installation is a major factor in reducing risks. These types of walls/shields are also becoming more commonplace in civilian buildings, such as schools. Typical barriers are formed from particularly heavy and high-impact resistance materials such as concrete or hardened steel in order to provide effective protection from bullet penetration. However, these barriers are difficult and/or slow to deploy, and their deployment may not even be possible for a human without assistance from mechanical devices such as electric motors. Moreover, when covering entrances such as windows and doors, certain deployable barriers may deploy in a vertical direction—for instance, they may slide downwards from above a window or door so as to cover it. Such barriers must deploy slowly as a quickly moving mass of steel can be fatal if it strikes a person from above.

Accordingly, there is a need to provide a wall/shield which provides adequate protection from firearms, other projectiles and impacts, but can also be deployed easily and quickly.

SUMMARY OF THE INVENTION

In a first aspect of the invention, there is provided a protective shield as defined in independent claim 1. In particular, the protective shield comprises a body for protecting a user from a projectile or impact, the body comprising a front strike face and an opposing rear face; and a connector arrangement provided on the body adapted so as to allow the shield to connect to an adjacent protective shield. The strike face has a perimeter defined by the edges of the strike face and the connector arrangement is arranged so that an adjacent protective shield can be connected to the connector arrangement with the body of the adjacent protective shield abutting and/or overlapping with the strike face of the protective shield at any point about the perimeter of the strike face.

Embodiments thus provide a shield or protective cover that can be used to protect a person or object by absorbing an impact (e.g. from a projectile, weapon or collision) and/or preventing penetration through the structure. The shield comprises a main body, which is the main portion of the shield and the part which protects a user from an impact and thus provides the protective function. The main body has an outer or strike face or surface, an inner or rear face or surface opposite the strike face and sides or edges which extend between the strike face and the rear face. The strike face has a perimeter or continuous edge which extends around it, which can be defined by the edges of the main body. The shield also comprises a connector arrangement or connection means which enables the shield to connect to an adjacent (e.g. abutting) second shield, for example one also having a connector arrangement. Importantly, the shield can be connected to other protective shields having the features of claim 1 to increase the protection offered to a user. This means that multiple shields can be used to create a continuous shield wall or protective barrier with a continuous strike face. This is of particular benefit where multiple users each have a single shield and can interconnect the shields to create a more effective protective barrier. Shields can also be assembled on top of each other in order to provide increased protection. Similarly, walls or barriers of significant surface area can be assembled and disassembled permitting easier transport and storage. For example, each shield may be independently carried by a person (for example, in a rucksack) and, when required, multiple users can connect the shields to form the barrier or wall.

The connector arrangement (or connector element/device), which is provided on the main body, is configured so as to allow an adjacent second shield to be connected around the main shield with the strike face of the second adjacent shield to overlapping or abutting the strike face of the first shield. In other words, the connector arrangement can be connected to an adjacent shield (and in some embodiments, the connector arrangement of the adjacent shield) and enables the second shield to be positioned relative to the shield so that the strike faces are in contact and/or have some degree of overlap from a front view (i.e. if viewed from the front of the shield (e.g. perpendicular to the strike frame) so that the strike faces form a continuous strike face layer or surface). This can be overlap with the strike faces in contact, or preferably with the strike face the shield in contact with the rear face of the other shield, or the opposite way around, so that the strike faces face substantially the same direction once connected. It is possible that in some embodiments, the composites behind the strike faces may not be in direct touching contact, for example, where they are covered by an additional material.

Moreover, the connector arrangement is adapted so that this abutting and/or overlapping can occur at any point around the perimeter of the strike face. In other words, the strike face of the adjacent protective shield can contact the protective shield at any point around the perimeter of the strike face of the protective shield and/or can overlap with any part of the perimeter of the strike face of the protective shield. The connector arrangement providing the ability to attach another protective shield (e.g. one having the features of the first aspect) at any point around the circumference has a number of important benefits. First, this means that the shield can be used to form a wall of numerous different configurations and shapes and, therefore, is customisable to the particular circumstances. For example, this can be configured to protect a greater area of a user's body or can be used to protect multiple persons. Additionally, the ability to connect to the device at any edge or part of the perimeter can reduce the likelihood of incorrectly trying to connect the shield parts, as can be problematic with devices that interconnect only at certain points. Situations requiring the assembly of such a protective barrier will usually be high stress situations and, therefore, the ability to attach another other shield at any position around the perimeter can reduce the risk of mistakes under these conditions.

The adjacent shield or shields to which the protective shield of the first aspect can be connected to can include the features of the first aspect. In one embodiment, the adjacent protective shield is the same or substantially the same as (e.g. identical to) the protective shield of the first aspect. Thus, in embodiments, this provides a shield which forms part of a modular wall which can be assembled and disassembled as required.

The body or main body can be any shape or configuration, including for example, a plate structure. The shape may be any shape, such as a polygonal shape, and may define a strike face with a circular or polygonal shape. It may have planar surfaces or may comprise 3d shaped surfaces (for example, the front strike face can be convex, with the rear face being concave). The strike face is the front or forward surface of the shield adapted to protect a user from an impact or penetration and directed towards the direction of expected impact or penetration. The strike face thus is the part of the shield that is visible from the front and which is forward of or incorporates a protective material (e.g. a composite structure, as set out in respect of the second aspect, below). The strike face and/or the rear face can, independently, be a planar or non-planar surface; for example, they each may be a planar surface defining a major face of a rectangular main body or it can have a bevelled edge or may be a 3D shaped surface. They each may be a single component face (e.g. a main planar surface) or can comprise multiple elements, such as a main planar face with side extensions and may have parts which are moveable relative to other sections. Thus, overlap or abutment of an adjacent protective strike face may take many forms and the surfaces combined may provide a continuous planar surface or may provide a non-planar surface. Where both strike faces are both planar or have a planar portion (e.g. a majority planar surface), the strike faces or planar portion of the strike faces may be parallel or may be in the same plane.

By overlap, it is meant that from a front view (the strike face defining a front surface) the perimeter of the strike face of the adjacent protective shield is received within the perimeter of the strike face of the protective shield. This can create a phalanx type arrangement, particularly where a plurality of adjacent protective shields are connected to the connector means. By abut it is meant that the connector arrangement is adapted to cause the strike faces of each in contact with one another. This can be the perimeters of the strike faces or another part of the strike face.

In an embodiment, the connector arrangement is adapted so that a plurality of adjacent protective shields can be connected to the shield (e.g. via the connector arrangement) and, in particular, so that the strike faces of the plurality of adjacent shields overlap or abut the strike face of the protective shield. The connector arrangement can therefore enable the connection of a number of protective shields thereby allowing numerous protective shields to be interconnected to provide a continuous shield wall. Since the connector arrangement allows the connection of these to provide abutment or overlap at any point around the perimeter of the strike face (for example, with the plurality of shields being provided abutting and/or overlapping different parts of the perimeter), this can be used to create a protective wall of numerous different configurations and arrangements, depending on the requirements when assembled (for example, number of people, size of area, size of people, threat involved) and the number of protective shields available to form part of the wall. This level of configuration is also advantageous as it means that there are numerous ways to connect other protective shields to the shield, rather than just a single way (for example), thus reducing the requirement for the adjacent shields to be connected to a single part or in a very precise manner, which reduces the difficulty in a stressful situation. The connector arrangement preferably provides a releasable connector arrangement which allows an adjacent shield to be releasably connected to the protective shield.

Where the connector arrangement is arranged so that the strike face of an adjacent shield connected to the shield will overlap with the strike face of the shield, this creates a phalanx-type arrangement, which is a particularly effective mode of protection. In particular, this ensures that there are no gaps between the two shields, between which a projectile could pass or a weapon could slip, and, instead, a region of increased impact protection is provided. If multiple adjacent shields are attached, this can create significant regions of overlap and thus increased protection. Moreover, this overlapping arrangement also can increase the structural strength of the combined shields, as they can bear on each other and will do so during an impact.

In another embodiment, the connector arrangement comprises first and second connector parts provided on the body, the first connector part being adapted to connect to a second connector part of another protective shield and the second connector part being adapted to connect to a first connector part of another protective shield. In other words, the connector arrangement has corresponding first and second connector elements, which can form two complimentary interconnection means. Thus, the second connector part of the protective shield can engage the first connector part of an adjacent protective shield and/or the first connector part of the protective shield can engage the second connector part of an adjacent protective shield. In some embodiments, the first and second connector parts may be used to engage different protective shields and in some embodiments, the first and second connector parts may each be adapted to engage or be capable of engaging multiple protective shields. By having parts which are connectable as corresponding parts, different configurations and restrictions can be created which ensure that the shields are connected in the desired manner. The connector parts in some embodiments can be any attachment means that has corresponding male and female parts, for example these may be connector strips which engage one another. These can be releasable connector parts, particularly releasable contact connector parts (e.g. connector parts which engage one another through contact of their respective surfaces). Examples, include parts comprising adhesives, connectable elements such as engageable clips, buttons, hook and loop fasteners (e.g. Velcro), touch fasteners. In one embodiment, the connector parts are a hook and loop or 'touch' fasteners (e.g. one of the first and second parts is a hook fastener, and the other is a corresponding loop fastener) as this can be readily removed, adjusted and does not need to be perfectly aligned, which is particularly beneficial where assembly in stressful situations is required. In embodiments, where releasable contact connector parts (e.g. hook and loop fasteners) are used, it is particularly advantageous if the body or shield is flexible, as this enables the connector parts to be more easily released; for example, if the shield needs to be repositioned to provide a different configuration.

In one further embodiment, the first connector part and the second connector part are each provided on the strike face and/or the rear face. In other words, the first connector can be provided on the strike face or the rear face (or in some embodiments, both). Independently, the second connector can be provided on the strike face or the rear face (or in some embodiments, both). In a further embodiment, each of the first and second connector parts extend around the edge of the strike face or rear face on which they are provided. In other words, at least a portion of each of the first and second connector parts extends alongside or at the respective face on which it is provided. In this way, the connector parts can provide specific configurations which dictate the specific arrangement of the shields. a way in which a second protective shield, or plurality of protective shields, can be attached to the protective shield. Each connector part may be an individual element (e.g. a connector strip) or a plurality or elements. In an embodiment, at least one of the first and second connector parts is offset from the edge of the face on which they are provided. This arrangement can provide overlap of the strike faces when it is connected to an adjacent shield. In another embodiment, the first connector part is provided on the rear face and the second connector part is provided on the strike face. In this way, when connecting to an adjacent shield, the strike face of the shield can contact the rear face of the adjacent shield or vice versa. Where the first and second connector parts may be arranged so that the strike face of an adjacent shield connected to the shield will overlap with the strike face of the shield, this creates a phalanx-type arrangement, which is a particularly effective mode of protection. Moreover, by providing the connectors on the faces and having each of one type on one face and the other type on the other, this can simplify the way in which these connect which can make it easier to connect the shields in a stressful situation.

In an embodiment, each of the first and second connector parts comprises a plurality of connector elements. Thus, in one embodiment, there are a plurality of first connector parts and/or a plurality of second connector parts. Thus, there can be multiple points on the multiple body to which an adjacent shield can connect. The connector parts may be arranged on the body so as to allow an adjacent shield to be received and overlap or abut any part of the perimeter. Each connector part may be adapted to connect to only a single connector part on an adjacent shield or, in some embodiments, each connector part may be adapted to connect to a single connector part and/or multiple connector parts. For example where the first and second connector parts correspond such that there are male and female connector parts, each connector part may be adapted to receive a single connector part of the opposing type and/or to receive multiple connector parts of the opposing type. In embodiments, where the body is a polygonal prism, such that the strike face has a polygonal shape having x sides or edges, there can be at least x of each connector part, each edge having at least one connector part.

In an embodiment, the shield further comprises a holding element provided on the body for allowing the shield to be held by or retained on a user with the strike face facing outwardly. The holding element can be a handle, for example, or may be a strap for attachment of the shield to a user's body or to an object. In some embodiments, there may be a plurality of holding elements. The holding element(s) may be provided on the rear face of the shield.

In an embodiment, the holding element or means defines at least part of the connector arrangement. In other words, the holding element may comprise at least a part of the connector arrangement or the connector arrangement may define the holding element. For example, where the connector arrangement comprises connector parts, the connector parts may be only partially attached to the body so as to that the unattached part defines a holding element.

In an embodiment, the body comprises a composite structure comprising at least one layer comprising graphene, and wherein the composite structure is arranged: (i) between the strike face and rear face; and/or (ii) so as to at least partly define the strike face and/or the rear face.

In a second aspect of the invention, there is provided a protective shield comprising a body for protecting a user from a projectile or impact, the body comprising a front strike face and an opposing rear face; and a connector arrangement provided on the body adapted so as to allow the shield to connect to an adjacent protective shield. The body comprises a composite structure comprising at least one layer comprising graphene, and wherein the composite structure is arranged (i) between the strike face and rear face; and/or (ii) so as to at least partly define the strike face and/or the rear face.

Embodiments thus provide a shield or protective cover that can be used to protect a person or object by absorbing an impact (e.g. from a projectile, weapon or collision) and/or prevent penetration through the structure. The shield comprises a main body, which can have a plate structure, which is the main portion of the shield which protects a user from an impact and thus provides the protective function. The shield also comprises a connector arrangement or means which enables the shield to connect to an adjacent shield, for example one also having a connector arrangement. Importantly, the shield can be connected to other protective shields having the features of the second aspect or the first aspect to increase the protection offered to a user. This means that multiple shields can be used to create a continuous shield wall or protective barrier with a continuous strike face behind which is provided an effective protective composite structure.

In an embodiment, the shield further comprises a holding element provided on the body for allowing the shield to be held by or retained on a user with the strike face facing outwardly. The holding element can be a handle, for example, or may be a strap for attachment of the shield to a user's body or to an object. In some embodiments, there may be a plurality of holding elements. The holding element(s) are preferably provided on the rear face.

In an embodiment, the connector arrangement is arranged so that an adjacent protective shield can be connected to the connector arrangement with the body of the adjacent protective shield abutting and/or overlapping with the strike face of the protective shield at any point about the perimeter of the strike face.

In a third aspect of the invention, there is provided a deployable shield wall assembly for selectively providing projectile or impact protection to an area, the deployable shield wall assembly comprising: a deployable shield wall for providing protection from a projectile or impact, the deployable shield wall comprising a strike barrier defined by at least one shield member; and a holding element connected to the deployable shield wall for retaining at least a part of the shield wall in a predetermined position. The deployable shield wall assembly is adapted such that the shield wall is deployable from a retracted configuration in which the deployable shield wall extends from the holding element into an area by a first amount to a deployed configuration in which the deployable shield wall extends from the holding element into the area by a second amount, the second amount being greater than the first amount, such that the strike barrier of the deployable shield wall provides projectile or impact protection in the area. The at least one shield member comprises a composite structure comprising at least one layer comprising graphene.

In other words, there is provided a shield wall or barrier that can be used to protect objects or people from damage and which can deploy, and optionally retract. For example, in one embodiment, deployment may be movement from a first position retracted from an opening or area in space (e.g. completely retracted so as not to be present in the opening or area in space, or at least partially retracted) to a second position in the opening or area in space (e.g. present in opening or area in space to a greater extent than in the first position, or even entirely within the opening). The shield wall is deployed from a holding element or retaining component, which can be a housing in which the shield wall is held or enclosed in the retracted configuration and to which the shield wall is connected and extends from in its deployed configuration. This means that the opening or area in space may be substantially open or uninhibited in the first retracted position and substantially closed or blocked in the second position. This movement could include the shield wall being folded, rolled or separated into component parts so as to be out of the opening/area in space (first state) moving to a second state (e.g. an expanded, unrolled, or connected state, respectively). In the deployed state, at least a part (and preferably all of) the strike barrier is within the opening/area so that it can absorb damage from a projectile or impact. It is the strike barrier (or ballistic component) which provides (the majority of) the impact absorbing properties/damage resistance of the shield wall. Thus, the strike barrier is a ballistic layer or impact absorbing layer provided by the shield members. The opening in space could be an opening defined between two points in space, for example the holding element and a second point in space offset or spaced apart from the holding element. This may be between the holding element and an adjacent structure, such as a wall or another shield wall assembly. In an embodiment, the shield wall may be raised off the ground, for example by a frame or by attachment to a support member, and be arranged or adapted such that the shield wall deploys vertically down, thereby extending out of the base of the holding element (or any housing thereof) until it contacts the adjacent structure. The holding element may thus hold the shield wall in a predetermined position adjacent a void. This may be fixed, for example, by securing the holding element to a structure.

Embodiments thus provide a deployable protective shield wall that is strong, yet light, particularly relative to previous deployable walls. As set out above, the materials used in the composite structure provide high performance impact and projectile protection, while remaining lightweight. This makes the wall easier to install and deploy as the total weight of the wall can be dramatically reduced without reducing protection. Moreover, as a result of the use of a graphene-based composite, the ability to reduce the weight while providing comparable protection means that the motors and other heavy duty deployment systems can be avoided and the shield wall can be deployed manually or by gravity. Embodiments using the latter are also safer as the risk of injury during deployment can be reduced as the wall is lighter and, in many embodiments, flexible. For example, if the wall deploys vertically downwards (e.g. under the force of gravity) a person is located beneath wall as it deploys is much less likely to be hurt, compared to prior art devices (e.g. steel shutters) even where they use a motor system. In addition, the properties of the composite structures set out herein mean that a very large surface area of shield wall can be provided without excessive structural support, at least because weight is less of a problem. Thus, this allows much more widespread installation without expensive and time consuming labour and equipment. This allows deployment in buildings such as schools and public places without requiring excessive modification.

The shield member(s) can have the structure of the body of the protective shields of the first and second aspects (without the requirement for a connector arrangement provided thereon). In some embodiments, the shield member(s) each comprise a body comprising a front strike face and an opposing rear face. The composite structure can be provided between the faces, or may define one or both of the faces. The shield member(s) can be arranged so that the front strike faces all face substantially the same direction and/or provide a continuous connected front strike face thereby defining a shield wall strike face. In some embodiments, the strike barrier is provided across the entire shield wall in the deployed configuration, or at least the entire shield wall provided beyond the holding element.

By a first amount, this can be zero (i.e. no extension of the shield wall from the holding element) or an amount less than the second amount. For example, where zero, this means that the shield wall does not extend beyond the holding element into the area (to be protected). In the deployed configuration, the shield extends beyond the holding element by a positive amount. "Amount" can be length or total surface area, for example. In an embodiment, the amount is a length of the shield wall and, preferably, the surface area of the shield wall in the area in the area in the retracted configuration is less than or equal to the surface area in the deployed configuration.

As set out above, the deployable shield wall assembly is adapted such that the shield wall can deploy from the retracted position to a deployed position. This can mean that the assembly can permit the deployment (e.g. with a deployment mechanism comprising a release mechanism) or can be adapted to positively deploy the device (for example, with a deployment mechanism that is adapted to actively move the shield wall, or by virtue of the arrangement of the assembly). In some embodiments, the deployable shield wall assembly may be further adapted to retract the shield wall from the deployed configuration to the retracted position. This could be by reversing a deployment mechanism, where present, or by virtue of a separate retraction mechanism.

In some embodiments, the shield wall assembly may further comprise a deployment mechanism, such as a release mechanism, which may be provided on the holding element in some embodiments. Thus, in the retracted position, the holding element may retain the shield wall in a first position, and then subsequently release a part of the shield wall while retaining another part of the shield wall so that the shield wall can be deployed, but a remains retained by the holding element. In some embodiments, the deployment mechanism is a release mechanism, which can allow the shield wall to automatically deploy such as under the force of gravity is suspended above a surface or can allow a user to deploy the mechanism (i.e. the deployment mechanism may be passive). In other embodiments, the deployment mechanism is adapted to move the shield wall from the first position to the second position (i.e. the deployment mechanism is active). This could be a driven moveable element, such as a moveable element adapted to engage the shield element and to travel along a track or to be propelled away from the holding element. A deployment mechanism may incorporate a control system or can be linked, for example, to a centralised control system. A control system may automatically detect a threat or event, such as by using systems for detecting gunshots using microphones or systems (e.g. video analysis) whereby shapes of potential offensive weapons, such as firearms, can be automatically detected. The deployment mechanism could incorporate or be linked to such a system such that the deployment of the shield wall is automatic. Alternatively, the deployment could be manually actuated by a user, locally or remotely. In some embodiments, plural shield walls assemblies may be connected in a network and controlled centrally by a single control system.

Deployment mechanisms, including release mechanisms, may include electronically released mechanisms (e.g. catches), such as remotely operated electromagnetic catches or electronic release mechanisms. It will be appreciated that electromagnetic catches could be used with non-electromagnetic fastening devices or members (such as metallic strips) and vice versa. In general, the electromagnetic connection systems are reliable as there are no moving mechanical parts which can snag or otherwise fail. Further, electromagnetic connections can be made to be exceptionally strong such that there is minimal possibility of disengagement when the system is active. Alternatively, or in addition, the deployment mechanisms may include fastening devices and/or catches which provide mechanical connections, such as poppers, permanent magnets, or other types of 'quick-release' fasteners known to the skilled person. Use of traditional fasteners may be advantageous in that can easily be operated locally by a user. In some embodiments, the fastening devices may engage with a releasable connection which can then be made permanent when the shield wall is deployed. Generally, traditional fasteners are advantageous in that they continue to operate in the event of a power cut.

The holding element (or retaining means) may comprise a holding member engaged with a portion (e.g. an edge) of the shield wall and/or a housing within which the shield wall is received (at least partially, but preferably fully) in the retracted position. This protects the shield wall from damage and manipulation prior to use.

In an embodiment, the deployable shield wall comprises a plurality of interconnected shield members. Thus, in an embodiment, the strike barrier of the deployable shield wall is defined by a plurality of interconnected shield members. In a further embodiment, the plurality of interconnected shield members are arranged so as to provide a continuous strike barrier. The strike barrier may be provided by multiple shield members which are in the part of the deployable shield wall extending from the holding element into the area when in the deployed configuration.

In other words, there can be plural shield members, which are each connected to one another, either directly or indirectly, for example by an additional element and/or via another shield member. In embodiments, each of the shield members are moveable relative to one another, thereby providing more flexibility with regard to arrangement of the shield wall and flexibility with regard to movement of the shield wall through the retracted and deployed configurations. In an embodiment, the plurality of interconnected shield members are arranged so as to provide a continuous strike barrier in the part of the deployable shield wall extending from the holding element into the area when in the deployed configuration. In other words, all of the shield members have edges (or perimeters) abutting or overlapping with adjacent shield members in the deployed configuration. This avoids any risk of penetration through gaps between the shield members. In some embodiments, the strike barrier is provided across the entire shield wall in the deployed configuration, or at least the entire shield wall provided beyond the holding element. This provides full coverage of protection. The front strike faces of the shield members may be all be arranged facing in the same direction in the deployed position. The shield members do not necessarily need to form a continuous wall in the retracted configuration or in the part of the shield wall not extending beyond the holding element, for example if not fully deployed.

In another embodiment, each of the plurality of interconnected shield members are moveable relative to one other; and wherein deployment of the deployable shield from the retracted configuration to the deployed configuration comprises movement of the shield members relative to one another. This may be from a collapsed position to an expanded position. This can mean that, in embodiments, the shield members can collapse into a configuration having a reduced footprint and then expand into the deployed configuration with an increased footprint. Footprint can mean the footprint when viewed from a front or rear direction (e.g. perpendicular from a major face of the shield wall). For example, the shield members can fold into a stack or array in the retracted configuration with the shield members arranged next to each other with their largest faces (e.g. their strike faces and rear faces) facing one another (e.g. aligned), thereby providing a reduced surface area strike barrier. This reduces the footprint of the shield wall. In the deployed position, these can be reconfigured so as expand the surface area of the strike barrier, for example by arranging the shield members next to each other, with the edges abutting or overlapping with adjacent shield members.

In an embodiment, the deployable shield wall further comprises a support screen to which each of the shield members is attached. In a further embodiment, the support screen is adapted to provide a continuous screen covering the shield members when viewed from at least one direction, and optionally wherein the support screen is a penetration-resistant support screen. In other words, there may be a screen (e.g. curtain or layer) to which each of the shield members is connected. The screen may extend over a part, but preferably substantially all, of one surface of the shield wall. Therefore, the screen acts to present a continuous face towards at least one direction in the deployed configuration such that an attacker is presented with a single, uniform surface, rather than a series of shield members. For example, where the shield wall is provided with opposing major faces (e.g. a planar shape or a substantially planar shape) the screen can define at least one of the major faces, preferably the forward face (i.e. the face directed towards an expected impact or projectile). Thus, in some embodiments, the support screen can define a front face of the shield wall (i.e. the outermost layer or part of the shield wall in a direction of expected impact). When defining the front face, the support screen can be adapted to provide a continuous screen covering the shield members when viewed from a direction perpendicular to the front face (e.g. from the front of the shield assembly). Embodiments incorporating a screen reduces the risk of attempted manipulation. This is particularly so where the screen is a penetration-resistant support screen (e.g. resistant to cutting, stabbing and/or projectiles), as this can act as a barrier to preventing an attacker passing through the shield wall and also from attempting to breach the barrier.

The screen can be formed of the protective or ballistic layer set out in respect of the other embodiments, but with this layer separate to the composite materials. Thus, the screen can comprise a metal, an alloy, a polymer and/or a carbon containing material, preferably a polymer and/or a carbon-containing material. For example, the protective layer may comprise a high-tensile polymer and/or carbon fibre containing material. In a further embodiment, the protective layer comprises a high-tensile material selected from the group consisting of aramid (aromatic polyamide) fibres, aromatic polyamide fibres, boron fibres, ultra-high molecular weight polyethylene (e.g. fibre or sheets), poly (p-phenylene-2,6-benzobisoxazole) (PBO), poly{2,6-diimidazo[4,5-b:4',5'-e]-pyridinylene-1,4(2,5-dihydroxy)phenylene} (PIPD) or combinations thereof. For example, in one embodiment, the screen is a UHMWPE textile with a weight of between 100 and 100 gsm, optionally between 100 and 800 gsm, 100 and 200 gsm or 140 and 180 gsm. Where fibres are used, the layer can comprise a binder, such as an epoxy resin. In an embodiment, the protective layer has a thickness of 50 μm to 500 μm, optionally 125 μm to 250 μm. In embodiments where there are a plurality of protective layers, each protective layer has a thickness of 50 μm to 500 μm, optionally 125 μm to 250 μm. In some embodiments, the screen may comprise a composite structure as defined in respect of any of the embodiments and aspects set out herein, the composite structure optionally being different to the composite structure of the shield member(s).

In an embodiment, the assembly further comprises an engagement element or retaining element spaced apart from the holding element, wherein the engagement element is adapted to engage a portion of the deployable shield wall in the deployed configuration to restrict movement of the shield wall. This allows the shield wall to be secured in the deployed configuration to prevent manipulation or removal and/or to restrict movement/deformation of the shield wall if impacted by a weapon or projectile, for example. The engagement element and the holding element can thus define an area to be protected between them (e.g. these could be considered to be first and second points in space) with the shield wall extending between the holding element and the engagement element (i.e. the two points in space) in the deployed configuration. Example engagement elements include clips, magnets and fasteners. In a preferred embodiment, the engagement element is adapted to automatically engage the shield wall in the deployed position. In a preferred embodiment, the engagement element is an electromagnet. This allows for easy control over the engagement, including release after deployment.

In an embodiment, the assembly further comprises at least one guide member adapted to guide the deployable shield wall during deployment from the retracted configuration to the deployed configuration, for example by engaging a portion of the shield wall. Optionally wherein the guide member is further adapted to engage the deployable shield in the deployed configuration to restrict movement of the shield wall. This can ensure that the shield wall deploys in a correct manner. The guide may be an elongate guide member arranged so as to engage (i.e. releasably engage) the shield wall along an edge of the shield wall so as to restrict movement along an edge. The guide member could comprise a channel for guiding the shield wall or could comprise a rail, for example, with a corresponding follower on the shield wall. The assembly may further comprise plural guide members, for example arranged opposite one another, which may also be arranged so as to engage the shield wall along an edge of the shield wall so as to restrict movement along an edge. In this way, the deployment can be guided along multiple edges of the shield to ensure it is in the correct position. Moreover, the use of guide members is particularly advantageous when combined with an engagement element, as the guide elements can guide deployment of the shield wall and retain it in the deployed configuration together with the engagement element, such that any movement of the deployed shield wall is prevented until the engagements are released.

In an embodiment, the assembly may comprise a frame at least partly defining an opening or void and the assembly is adapted such that the shield wall deploys from a retracted configuration in which the deployable shield wall extends from the holding element into the opening by a first amount to a deployed configuration in which the deployable shield wall extends from the holding element into the opening by a second amount, the second amount being greater than the first amount, such that the strike barrier of the deployable shield wall provides projectile or impact protection to the opening. Thus, the shield can extend within a space defined by the perimeter defined by the frame. In some embodiments, the assembly may be adapted such that the opening is closed or blocked by the shield wall in the deployed position, but may permit passage therethrough in the open position. The frame may be, in some embodiments, formed form a plurality of members arranged to define an enclosed void or opening. It may be formed from separate members, or may be at least partly formed from the other components of the shield wall assembly, for example the holding element or guide members. For example, the two opposing guide members and the holding element may define a three-sided frame, with the holding element located adjacent a first end of the guide members and extending between the guide members. In some embodiments at least one engagement element (e.g. a member having an engagement element thereon) is located at the second, opposite end of the guide members and extends between the guide members. In embodiments, the area into which the shield wall is deployed, is at least partly defined by the perimeter of the frame. In other embodiments, a frame may comprise at least one member defining the frame and the holding element may be arranged adjacent the frame.

In an embodiment, the assembly is arranged such that, in the retracted position, the deployable shield wall and holding element are raised or elevated above a surface; and wherein deployment of the shield wall comprises release of a part of the shield wall such that the shield wall is deployed towards the surface under the force of gravity. This provides a relatively simple and fast design that case be used to quickly provide a protective barrier. No ancillary mechanism (e.g. a motor) is required and the device can deploy under the weight of the shield alone, for example. Moreover, the release mechanism can be relatively simply, for example a latch, such that the overall assembly is simply to use and manufacture. Moreover, a result of the relatively light, but effective, composite structures used herein, damage to objects or persons on the surface is reduced compared to heavy prior art systems.

The holding element can be raised or elevated above a surface by any suitable means, such as attachment to a ceiling or raised surface, or by use of a frame to elevate the shield wall and holding element.

As set out in more detail below, in some embodiments, the layer comprising graphene is a planar layer of graphene and/or comprises graphene in the form of graphene platelets. The composite structure may further comprise a protective layer. In embodiments, the composite material further comprises a second layer comprising an aerogel. In further embodiments, the composite material comprises a plurality of first layers each comprising graphene; and a plurality of second layers each comprising an aerogel, wherein the first and second layers alternate in the composite structure. In the above embodiments, at least one of the second layers may be a polyimide aerogel. In some embodiments, the composite structure further comprises a third layer comprising a polymer, the third layer being provided adjacent a second layer comprising an aerogel.

The following embodiments related to features are relevant to all of the first to third aspects and are disclosed herein in combination with each of these aspects. For example, each of the first, second and third aspects are disclosed above as comprising a composite structure and, therefore, any of the embodiments disclosed below apply equally to any of the composite structures of the first, second and third aspects. This includes, but is not limited to, the presence of aerogel, number of layers, configuration of layers, orientation, etc.

The composite or laminate structure present in the above aspects comprises at least one layer comprising graphene (e.g. graphene nano-platelet (GNP)). Thus, the composite structure can have a plurality of layers, of which at least one comprises graphene (e.g. GNP) or is a graphene containing layer. Graphene is an allotrope of carbon, in its fundamental form, consisting of a two-dimensional single layer of carbon atoms arranged in a single planar sheet of sp2-hybridized carbon atoms (GNPs consist of a few layer graphene materials). Graphene is known for its exceptionally high intrinsic strength, arising from this two-dimensional (2D) hexagonal lattice of covalently-bonded carbon atoms. Embodiments can provide a composite with very advantageous properties including a combination of strength, low weight and resilience. In the context of a laminate or composite structure in the shield of the first and second aspects, this has the benefits of providing a lightweight shield (relative to the protection offered by prior art materials). The shield can be easy to transport and assemble, which remaining strong and effective at protecting a user. In the context of the third aspect, this has the significant benefit of providing a shield wall that is easier to assemble and deploy, as it is lighter but while still providing protection. This also has the advantage of reducing the risk of injury when deployed, for example.

In an embodiment, the composite material is flexible, and optionally resilient. By flexible, it is meant that the composite material can deform under the application of a force (e.g. a force to one end while the opposing end of the composite material is restrained) without damaging the structure of the composite material (e.g. without tearing or breaking). For example, it can deform without breaking using a three-point bend test. By resilient, it is meant that the composite material will return to its original shape after deformation. In a further embodiment, the body is flexible, optionally the shield (e.g. as a result of flexibility the body, holding elements (where present), connector arrangement and any other components) is flexible. The body and shield may also be resilient. This is particularly beneficial as it can make it easier to position the shield and adjacent shields of the first and second aspects with flexibility and, importantly, the overall shape of the shield wall created by the individual protective shields can be more readily customised. For the third aspect, this provides a shield wall that can be retracted and deployed in other ways, such as by rolling and unrolling. This could, for example, be measured by a three point bend test or a four point bend test (e.g. as set out in ASTM-C1341 or ASTM-D7264).

The graphene layer of any of the above aspects, or in some embodiments the composite or laminate structure, can extend at least partially in or in a plane parallel to a plane defined by the strike face layer of the shield or shield member (for example, where the strike face layer may define multiple different planes, the graphene layer may extend in a plane parallel to one of these planes or may be part of the plane of the strike face layer such that it defines the front surface of the shield), or the plane where the strike face layer is planar. In other words, it may be parallel to a part or the whole of the strike face or it may define the strike face or part of the strike face. This can be a linear (straight or flat) layer or structure or it can be non-linear. For example, where non-linear, the strike face and the structure could define two parallel (or offset) curves.

The composite structure of any of the above aspects can comprise a plurality of layers. Each consecutive layer may be directly or indirectly in contact with the other layers of the composite structure. For example, the composite structure may further comprise additional layers provided between a first layer and a second layer. The composite structure may also comprise additional layers provided on top (e.g. on the upper surface of the uppermost layer) or bottom (e.g. on the lower surface of the lowermost layer) of the composite structure. Each layer may fully cover a surface of an adjacent layer or may only partially cover the surface of an adjacent layer. In some embodiments, a layer may extend beyond the edge of an adjacent layer. The layers may also each include further components or additives. For example, in some embodiments the graphene layer may comprise a polymer (e.g. polyurethane). In the composite structure, the layers may each have a thin sheet structure—i.e. with two larger opposing faces connected by four smaller edges.

In an embodiment of any of the above aspects, the at least one layer consists essentially of graphene. In a further embodiment, there may be a plurality of first layers comprising graphene, and in some embodiments, each (all) of the first layers consist essentially of graphene. The term "consists essentially of . . . " means that the first layer is almost entirely formed from graphene, but may contain minor quantities of other materials (for example, as a result of contamination or as a result of the method of forming the graphene layer). For example, it may be formed from 95% or greater graphene (by weight or by volume), preferably 98% or greater, more preferably 99% or greater or even more preferably 99.9% or greater graphene.

In an embodiment of any of the above aspects, the at least one layer comprises graphene in the form of graphene nano-platelets or powder. In a further embodiment, there may be a plurality of first layers comprising graphene, and in some embodiments, each (all) of the first layers comprises graphene platelets. The graphene platelets may be in the form of pure graphene platelets or as graphene platelets in a matrix. In some cases, the graphene may be functionalised to improve compatibility with a solvent in the manufacturing process, for example by functionalising using plasma treatment. For example, in some embodiments graphene may be functionalised using carboxyl groups. One example is a plasma treatment of "oxygen" functionalisation using the Haydale HDLPAS process, which is set out in WO 2010/142953 A1. The graphene platelets can have an average particle size (i.e. a $d_{50}$ number from particle size distribution relating to an average particle size) in the lateral dimension (i.e. at the greatest width across the face of the platelet) of at least 1 μm, optionally at least 2 μm, at least 5 μm, at least 15 μm, at least 25 μm (e.g. 1 to 10 μm, 1 to 5 μm, 1 to 25 μm or 1 to 40 μm). Number average thickness of the platelets can be less than 350 nm, e.g. 250 nm or less (e.g. this can be 200-600 stacked graphene layers of 0.35 nm thickness each), 200 nm or less, 100 nm or less, or 50 nm or less. These measurements can all be measured by SEM. The nano-platelets can comprise single or multiple layers of graphene.

In some embodiments of any of the above aspects, graphene is provided the at least one layer or, where there are a plurality of first layers comprising graphene, in each of the first layers (independently or all of the layers) in an amount of at least 0.1 wt %, at least 1 wt %, at least 2 wt %, at least 5 wt %, at least 10 wt %, at least 50 wt %, at least 80 wt % or at least 95 wt %. For example, the graphene content may be between 0.1 wt % and 99 wt %, 1 wt % and 80 wt %, 2 wt % and 50 wt %.

The graphene (e.g. in platelet form) may be provided in a matrix, such as a polymer matrix. Thus, in some embodiments, the first layer further comprises a polymer. Embodiments can be advantageous as these provide a matrix for the graphene, which can aid manufacture and other properties, such as resilience of the graphene layer. Moreover, when added to many polymers, graphene can significantly increase the tensile strength of that polymer. One practical weakness of graphene is the difficulties in manufacturing layers of significant size and thickness, especially since that for many implementations numerous (sometimes millions) of layers of graphene may be required to provide a material with useful characteristics. In the embodiments disclosed herein, this can be addressed by functionalising graphene and dispersing it in a polymer layer, thereby enabling the production of larger sheets. Methods of incorporating the graphene into a polymer or other matrix can include the use of mill rolling, such as dispersion using a three-roll mill. This can allow for dispersion of the graphene without the need for solvents and in a relatively high-throughput manner.

In some embodiments of any of the above aspects, the at least one layer comprising graphene or, where there are a plurality of first layers comprising graphene, each of the first layers (independently or all of the layers), has a thickness of from 0.34 nm to 20 μm. This can include a thickness of from 1 nm to 10 μm, 10 nm to 5 μm, 10 nm to 1 μm or 20 nm to 100 nm. In some embodiments, the first layers all have substantially the same thickness.

In some embodiments of any of the above aspects, the at least one layer comprising graphene or, where there are a plurality of first layers comprising graphene, each of the first layers (independently or all of the layers), is a planar layer of graphene extending in a plane parallel to a plane defined by an adjacent second layer. The layer or layers may also extend in a plane parallel to a plane defined by the strike face. In other words, the graphene is formed as a planar layer along and parallel to a surface of an adjacent second layer, or the strike face. This is advantageous as the alignment of the graphene layer on the aerogel means that an impact coming in a direction perpendicular to the plane of the graphene will have to overcome the graphene in its strongest direction, and subsequently will impact the aerogel in a direction in which it can readily dissipate the force in the plane of the layer. Thus, these embodiments are particularly effective at absorbing an impact provided in a direction substantially perpendicular to the plane of the graphene layer. In an embodiment where there are a plurality of layers comprising graphene, each of the first layers is a planar layer of graphene extending in a plane parallel to a plane defined by an adjacent second layer. In an embodiment, the layer(s) is/are a mono-layer, a bi-layer or a tri-layer of graphene. In other words, the layer comprises 1 atomic layer of graphene, 2 atomic layers or 3 atomic layer of graphene. Advantageously, the impact resistance of two or three atomic layers of graphene is significantly greater than a single atomic layer of graphene. In some embodiments, the layer(s) comprise(s) at least 1 atomic layer of graphene, at least 5 atomic layers, at least 10 atomic layers of graphene. Preferably, in some embodiments, the layer comprises from 1 atomic layer of graphene to 10 atomic layers of graphene. Impact resistance has been observed to deteriorate with more layers, and by circa 10 layers the performance begins to decrease.

In an embodiment of any of the above aspects, the composite material further comprises a second layer comprising an aerogel. Thus, in this embodiment there is at least a first layer comprising graphene and a second layer comprising an aerogel. Aerogels are a class of highly porous (typically nano-porous) solid materials with a very low density and which are very strong relative to their weight, making them useful in composites. As explained in more detail below, aerogels are formed by creating a gel and subsequently drying the gel to remove the liquid component (e.g. using supercritical drying). This creates the unique structure which contributes to the advantageous properties, including low density and the ability to transfer and dissipate impact forces effectively. The combination of these two materials leads to advantageous properties of the composite. In some embodiments, the composite material comprises a plurality of second layers, each second layer comprising an aerogel.

In particular, embodiments comprising graphene and an aerogel are particularly good at protecting a person or object by dispersing the force of an impact (e.g. from a projectile, weapon or collision) and/or preventing penetration through the structure. Embodiments of the composite structure achieve this by absorbing the impact and providing a protective structure that resists penetration through the particular combination of layers and the use of an aerogel layer, as explained in more detail below. For example, the combination of the aerogel layer and the graphene layer is advantageous, as the graphene layer provides a high-tensile layer (i.e. the tensile strength of the first layer (graphene-based) is stronger than that of the second layer (aerogel-based)) which serves as a barrier to penetration and at least partly reduces the force while the aerogel can absorb a substantial portion of the impact. As a result of the use of this structure, embodiments provide stab and bullet resistant structures (and thus shields and shield walls) at significantly less weight compared to prior art structures offering comparable protection.

As mentioned above, aerogels are a class of highly porous (typically nano-porous) solid materials with a very low density. More particularly, an aerogel is an open-celled structure with a porosity of at least 50% (but preferably with a porosity of at least 95% air (e.g. 95 to 99.99%), optionally at least 99%) produced by forming a gel in solution and subsequently removing the liquid component of the gel using supercritical heating. As a result of the drying conditions, the solid portion of the gel maintains its structure as the liquid component is removed, thereby creating the porous body. The pores of an aerogel will typically have a pore size in the range of 0.1 to 100 nm, typically less than 20 nm. In embodiments, however, the aerogel can have a pore size in the range of 0.1 to 1000 nm, optionally 0.1 to 900 nm; 10 to 900 nm; 20 to 900 nm; 20 to 500 nm; or 20 to 100 nm. In embodiments, the porosity and pore size distributions of the aerogels can be measured using nitrogen absorption at 77K and applying the Brunauer, Emmit and Teller (BET) equation (see "Reporting Physisorption Data for Gas/Solid Systems" in Pure and Applied Chemistry, volume 57, page 603, (1985)). An aerogel can be formed from a number of materials, including silica, organic polymers (including polyimide, polystyrenes, polyurethanes, polyacrylates, epoxies), biologically-occuring polymers (e.g. gelatin, pectin), carbon (including carbon nanotubes), some metal oxides (e.g. iron or tin oxide), and some metals (e.g. copper or gold). In some embodiments, the aerogel is a cross-linked aerogel (e.g. the aerogel is formed from a cross-linked polymer, e.g. a cross-linked polyimide). Such aerogels are advantageously flexible and strong. Aerogels offer increased impact absorbing properties as they offer a much broader cone of force dispersion than the components of prior art composites and thus impact forces can be dispersed much more quickly and widely. This is at least in part due to the ability of these layers to spread impacts out in the plane of the layer, as well as through the height of the layer. In particular, the "nano-auxetic" structure of aerogels can provide them with shock-absorbing properties—the nanometre-sized tree-branch-like atomic structures spread the force of an impact along those branches, thereby rapidly dissipating the force of an impact.

These layers are particularly advantageous when used together as the high-tensile strength of the graphene-containing layer helps to hold the composite together, while also providing the other benefits mentioned herein, and the nano-auxetic aerogel layer helps to disperse any impact forces, thus lessening the direct in-line force that is transmitted to the next graphene layer, and so forth. The graphene layer also reduces the tendency for a projectile or impact to penetrate through the aerogel without dispersing sufficient force. Together, these enable the composite structure to disperse force to a greater extent than using these layers on their own. This also means that the composite can withstand a greater degree of wear and tear than these materials can individually.

In an embodiment, the second layer, or where plural second layers each second layer independently, has a thickness of 20 μm to 1000 μm. For example, this can include a thickness of from 50 μm to 800 μm, 100 μm to 500 μm or 125 μm to 250 μm. In some embodiments where plural second layers, the second layers all have substantially the same thickness.

In an embodiment, the composite material comprises a plurality of first layers each comprising graphene; and a plurality of second layers each comprising an aerogel, wherein the first and second layers alternate in the composite structure. Embodiments of the shields and shield walls of any of the above aspects can therefore provide a composite with very advantageous properties including a combination of strength, low weight and resilience.

In an embodiment, each first layer is bonded to an adjacent second layer. In other words, each graphene layer is bonded to an adjacent aerogel layer. This can be directly (i.e. with direct contact between the graphene layer and the aerogel layer and bonded provided by the adhesive nature of either of the first or second layer) or indirectly (with another component, for example an adhesive or another layer, provided between the graphene layer and the adjacent aerogel layer). This is advantageous as this has been found to improve ballistic performance of the composite and thus will increase the ballistic performance of the shields and shield walls of the above aspects. By adjacent second layer, it is meant one of the second layers on either side of the first layer (i.e. next to the first layer). In some embodiments, the structure is orientated with an upper graphene layer being bonded to a lower aerogel layer. This can, for example, then be arranged with the graphene layer being the layer closest (of the two layers) to or defining the strike face and the aerogel layer behind the graphene layer, relative to the front strike face of the shield or shield member.

In some embodiments, each first layer is directly bonded to an adjacent second layer such that the graphene layer is provided on an adjacent aerogel layer. In some embodiments, all of the layers of the composite are bonded together. In other words, (all of) the first and second layers are bonded together, as well as any other layers present in the composite. Thus, a first layer may be bonded to the two adjacent second layers, and vice versa. When bonded together in a multi-layered sandwich, the resulting composite has both high strength and extreme lightness, as a result of the high aggregate strength. As such, the shields and shield walls will be particularly effective at preventing damage, while also remaining light. Accordingly, in some embodiments there is a composite formed of alternating layers of graphene and nano-porous materials (aerogels), wherein bonding is provided between the graphene and aerogel layers In another embodiment of any of the above aspects, a fastening element or means is provided to secure the first and second layers of the composite structure together, the fastening element or means being provided along an edge of the composite structure. By 'provided along the edge' it is meant that the fastening element or means (e.g. stitching or staples) are provides adjacent and along the edges of the composite structure (from a top-down view) and extend through the layers to secure the layers together. The fastening element constrains the edges of the composite. It has been found that this can dramatically improve the performance of composite and the same level of penetration-resistance (e.g. stab)

and/or ballistic performance can be achieved with fewer layers. In another embodiment, a fastening element or means is provided to secure the layers of the composite structure together, the fastening element or means being provided along an edge of the composite structure. In embodiments where the composite structure defines the body or extends over the majority of the body, the fastening element or means can be provided around the edge of the strike face.

In an embodiment, the composite structure comprises between 2 and 250 first layers (i.e. layers comprising graphene) and/or 2 and 250 second layers (i.e. layers comprising aerogel). In an embodiment, the composite comprises at least 5 layers, at least 10 layers or, in some embodiments, at least 25 layers. For example, there may be 10 to 200 layers, 25 to 150 layers, 50 to 125 layers. The number of first layers may be the same as the number of second layers. In some embodiments, the number of first layers is at least 5, at least 10 or, in some embodiments, at least 25. For example, there may be 10 to 100 layers or 25 to 50 first layers. It has been found that an increased number of layers can lead to a projectile being stopped earlier in the composite than in cases where there are fewer layers. This may be as a result of a shear thickening effect.

In an embodiment, at least one of the second layers is a polyimide aerogel. In a further embodiment, each (all) of the second layers is a polyimide aerogel. Polyimide aerogels have been found to be particularly effective in such a composite structure as they have some flexibility while also having a relatively high-tensile strength compared to other aerogels. This can also impart flexibility to the whole shield/shield wall, which is particularly advantageous as it makes it easier to store and the shield can more readily conform to the object(s) or person(s) it is being used to protect. Furthermore, polyimide-based aerogels also form less dust than silicon-based aerogels, reducing the likelihood of inhaling any aerogel-derived dust. Polyimide-based aerogels also recover from impacts/compressions better than silicon-based aerogels—a key performance criteria for impact protection and providing improved multi-hit protection.

In another embodiment of any of the above aspects, the composite structure further comprises a third layer comprising a polymer, the third layer being provided adjacent a second layer comprising an aerogel. The polymer may also provide resilience for the aerogel layer and it has been found that polymer layers used in conjunction with aerogel layers improves the effectiveness of the composite structure by helping to hold the structure together and dispersing forces acting upon the structure. This is particularly effective for the polymer layers located in front of the aerogel layer (relative to the direction of a force acting upon the structure—for example, with the composite arranged so that the polymer is located between the strike face and the aerogel (or with the polymer defining the strike face). Thus, in some embodiments, the first layer comprising the polymer is provided as an upper layer, with a second layer below or behind the layer. In some embodiments, there may be a plurality of different polymers and/or the polymer may be a copolymer. The polymer can result in the first layer acting as a binding layer adapted to hold together the structure of an adjacent aerogel layer. The polymer may be a single polymer or may be a polymer blend. The polymer can have a number average molecular weight of at least 1,000 Da; for example, at least 10,000 Da (e.g. 10,000 Da to 100,000 Da). In an embodiment, the polymer is selected from polyurethane, polyethylene (including ultra-high molecular weight polyethylene), polypropylene, polyester, polyamide, polyimide, epoxy resin or combinations thereof. In some embodiments, the polymer comprises polyurethane and/or an epoxy resin (e.g. a thermosetting network polymer formed from an epoxy resin with a hardener). Polyurethanes are particularly advantageous as the structure comprises rigid sections (based around the isocyanate groups) and soft flexible regions (around the diol groups), which make it suited to providing impact protection while remaining flexible. Other components can also be present. Use of a cross-linked polymer is particularly advantageous as this encourages dissipation of a force across the entire polymer layer.

The composite structure can at least partially define one or both of the strike face and/or rear face, it can be provided between the strike face and the rear face or both. In other words, it is either provided as the strike face or behind the strike face so that any object impacting the strike face will contact the composite material. In some embodiments, the composite structure extends across or behind at least 50% of the area of the strike face, preferably at least 70%, at least 80%, at least 90%, at least 95%. In some embodiments, the composite structure substantially entirely (e.g. there may be edges of the strike face where a cover extends over the edges of the composite structure) or entirely defines the strike face or is provided behind substantially all or all of the strike face. In some embodiments, the main body is defined by the composite structure. The composite structure can have a series of consecutive layers and may be arranged such that the layers are substantially aligned with a part of the strike face (or one of the layers may define the strike face).

In an embodiment of any of the above aspects, the composite structure further comprises a protective or ballistic layer. Thus, the composite can comprise at least a second type of high-tensile layer, in addition to the graphene-layers. The protective or ballistic layer can have a higher tensile strength than the second layer and optionally than first layer and as such provides a high-tensile layer (for example, the layer may have a tensile strength of at least 200 MPa, at least 500 MPa, at least 1000 MPa; for example, 250 MPa to 5000 MPa; 1000 MPa to 5000 MPa). This can be measured, for example, by ASTM D7269 where the protective layer is a fibre-based layer and ASTM D3039 for polymer matrix based materials. The protective layer absorbs a portion of the impact and assists in preventing penetration through the structure together with the graphene layers, with the aerogel layers acting as impact absorbing layers, so as to reduce the force transferred through the structure. In an embodiment, the protective layer comprises a metal, an alloy, a polymer and/or a carbon containing material, preferably a polymer and/or a carbon-containing material. For example, the protective layer may comprise a high-tensile polymer and/or carbon fibre containing material. In a further embodiment, the protective layer comprises a high-tensile material selected from the group consisting of aramid (aromatic polyamide) fibres, aromatic polyamide fibres, boron fibres, ultra-high molecular weight polyethylene (e.g. fibre or sheets), poly(p-phenylene-2,6-benzobisoxazole) (PBO), poly{2,6-diimidazo[4,5-b:4',5'-e]-pyridinylene-1,4(2,5-dihydroxy)phenylene} (PIPD) or combinations thereof. For example, in one embodiment, the protective layer is a UHMWPE textile with a weight of between 100 and 1000 gsm, optionally 100 and 800 gsm, 100 and 200 gsm or between 140 and 180 gsm. Where fibres are used, the layer can comprise a binder, such as an epoxy resin. In an embodiment, the protective layer has a thickness of 50 μm to 500 μm, optionally 125 μm to 250 μm. In embodiments where there are a plurality of protective layers, each protective layer has a thickness of 50 μm to 500 μm, optionally 125 μm to 250 μm.

Where there is the combination of at least one graphene layer, at least one aerogel layer and at least one protective layer, this is particularly advantageous as the protective layer provides a high-tensile layer which serves as a barrier to penetration and at least partly reduces the force of the impact before the backing structure can absorb a substantial portion of (or the remainder of) the impact. This reduces the likelihood of failure of aerogel layer under the initial peak force (particularly when provided in front—i.e. as the strike face or as the layer closet to or adjacent the strike face) and thereby reduces the likelihood that that the aerogel will fracture. In turn, this allows the aerogel to absorb more of the impact and thereby provide better protection.

In a further embodiment, the protective layer comprises an interlaced or interweaved arrangement of wound fibres. In other words, the protective layer comprises an arrangement having cables or laces formed of a plurality of wound or spun fibres, the cables of laces being arranged in an interlaced or interweave arrangement. In some embodiments, the wound fibres or cables are arranged in a crocheted or warp-knitted pattern (e.g. a raschel knit). In other embodiments, the protective layer comprises a single fibres arranged in a crocheted or warp pattern. This can provide a layer that is significantly stronger than the standard weaved layers of single fibres and bundles of continuous fibres ("tows"—for example, a carbon fibre tow consists of thousands of continuous, untwisted filaments). Moreover, layers in these embodiments do not necessarily require any form of binder (e.g. a polymeric resin).

In an embodiment, the composite structure is arranged with the protective layer adjacent or defining the strike face. In this way, the protective layer can absorb the initial peak force and resist penetration, while the remaining layers deform to absorb the impact. Thus, in some embodiments, the protective layer is provided as an upper or forward layer and first and second layers are provided below or behind the protective layer. Thus, the protective layer acts a cover layer and can be arranged as the first layer of the composite to receive the impact of an article or projectile. In embodiments of the third aspect, the protective layer may be in addition to the support screen.

In an embodiment, the first layer (graphene layer) is a flexible first layer and/or, where present, the second layer (aerogel layer) is a flexible second layer. The protective layer may also be flexible. Depending on the particular formulation and/or fabrication process, each of the layers can be made so as to be flexible and/or resilient such they can at least partially deform under without fracturing. For example, the first layer may comprise graphene and a flexible/resilient polymer (e.g. an elastomeric polymer) and/or the second layer may comprise a flexible aerogel (e.g. a cross-linked aerogel, for example polyimide aerogel). These can therefore provide a flexible body and, optionally, a flexible shield in the first and second aspects, and a flexible shield member and, optionally shield wall, in the third aspect.

Although the first and second aspects have been described as two separate aspects, the shield in the first aspect may comprise a composite material having graphene and may further comprise any of the features referred to in respect of the embodiments disclosed in respect of the second aspect. For example, the shield of the first aspect may comprise a composite material having at least one graphene layer and may further comprise at least one second layer comprising an aerogel and/or a protective layer. Similarly, the shield of the second aspect may comprise any of the features of the embodiments disclosed in relation to the first aspect. For example, in addition to the connector arrangement being adapted so that an adjacent protective shield can be connected to the connector arrangement with the body of the adjacent protective shield abutting and/or overlapping with the strike face of the protective shield at any point about the perimeter of the strike face, it may comprise any of the connector arrangements discussed in respect of the first aspect and/or the holding elements. The definitions set out in respect of the features and words used in conjunction with the first, second, and third aspects apply equally to both aspects.

In a fourth aspect, there is provided a protective shield wall, comprising a plurality of protective shields of any of the first and second aspects, wherein each of the protective shields is connected to at least one adjacent protective shield the body of the adjacent protective shield abutting and/or overlapping with the strike face of the protective shield.

If the term "adapted to" is used in the claims or description, it is noted the term "adapted to" is intended to be equivalent to the term "configured to".

BRIEF DESCRIPTION OF THE DRAWINGS

Specific embodiments of the invention will now be discussed in detail with reference to the accompanying drawings, in which:

FIGS. 11*a* and 11*b* shows a front view of a composite material being tested in a test rig;

FIGS. 12*a* and 12*b* show a front view of a composite material undergoing ballistic testing;

Like reference numerals are used for like parts; for example, "100", "200" and "300" refer to a shield.

DETAILED DESCRIPTION OF THE INVENTION

Figure 1A:
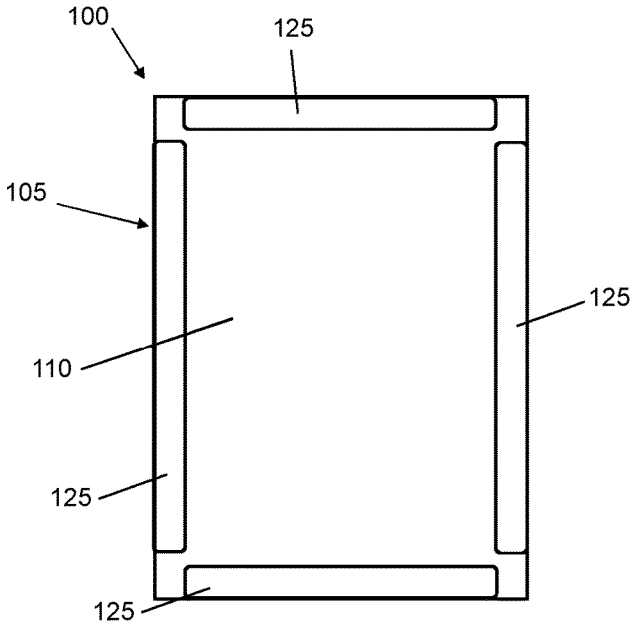
FIGS. 1*a* to 1*c* shows a front view, rear view and perspective view, respectively, of a protective shield according to an embodiment of the invention.
Figure 1B:
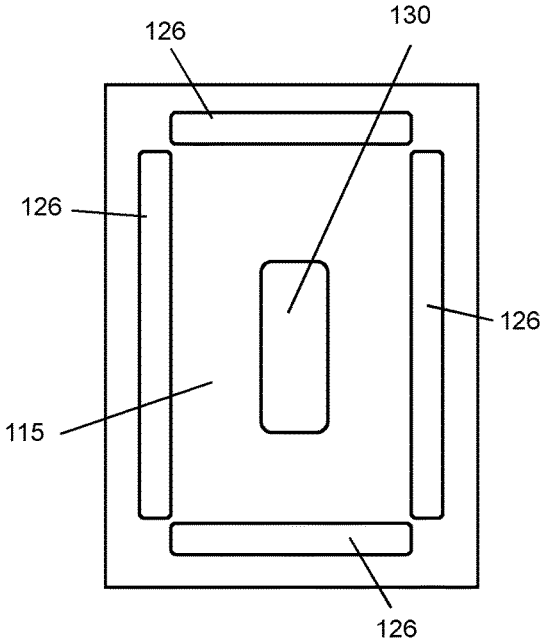
Figure 1C:
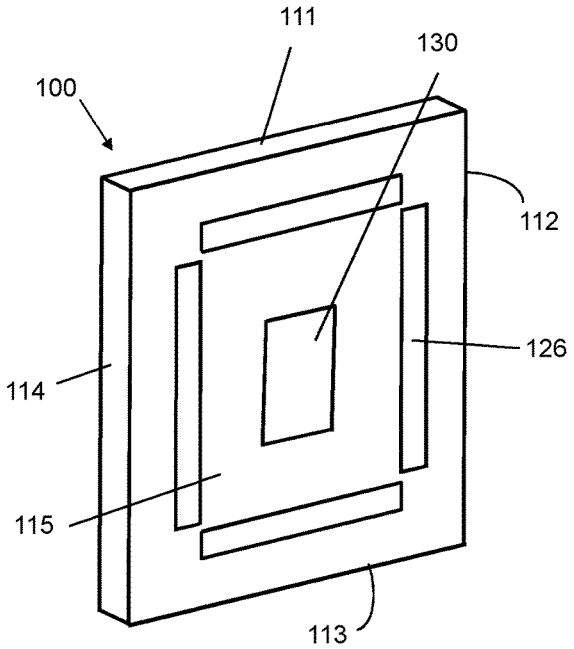

A protective shield 100 according to an embodiment of the invention is shown in FIGS. 1*a* to 1*c*. The protective shield 100 comprises a body 105, which in this embodiment has a cuboid shape. The body 105 has a front rectangular strike face 110 and an opposing rectangular rear face 115, which are interconnected by edges 111, 112, 113, 114. Thus, both the strike face 110 and rear face have a perimeter defined by edges 111, 112, 113, 114. Between the strike face 110 and the rear face 115 is provided a ballistic-resistant composite material 170, which is capable of stopping projectiles from passing through the body 105. The composite 170 is discussed in more detail, below.

The protective shield 100 also comprises a connector arrangement comprised of a set of corresponding male and female connector elements 125, 126 provided on the body 105 so that the shield 100 can be connected to adjacent protective shields 100. In particular, the connector arrangement comprises four releasable elongate male connector strips 125 provided around the perimeter of the strike face 110, with one of the male connector strips 125 provided adjacent each one of the four edges 111, 112, 113, 114 of the body 105. The connector arrangement also comprises four releasable elongate female connector strips 126 provided around the perimeter of the rear face 115, with one of the female connector strips 126 provided adjacent but offset from each one of the four edges 111, 112, 113, 114 of the body 105. In this way, the male connector strips 125 provided on the front strike face 110 of the protective shield 100 can be connected to female connector strips 126 on a rear face 115 of a second protective shield 100. Each male connector strip 125 extends along the majority of the length of the respective edge 111, 112, 113, 114 to which it is adjacent. Although this does not form a complete continuous connector strip array, due to the shape of these connector strips 125 and the arrangement of the female connector strips 126, this arrangement allows for the protective shield 100 to overlap with another protective shield 100 at any point about the perimeter of the strike face 110 (and similarly, the perimeter of the strike face 110 of the other protective shield 100).

The protective shield 100 also comprises a handle 130 provided in the centre of the rear face 115 of the body 105 for allowing the shield to be held by a user with the strike face 110 facing outwardly. The handle 130 handle in this embodiment is an elongate strip of material with the top and bottom of the handle 130 stitched to the rear face 115 so as to allow a user to put their hand or arm between the middle of the handle 130 and the rear face 115. In this embodiment, although not necessary, the handle 130 is also provided with the same releasable female connector material as the female connector strips 126 so that it can also be connected to male connector strips 125.

Figure 1D:
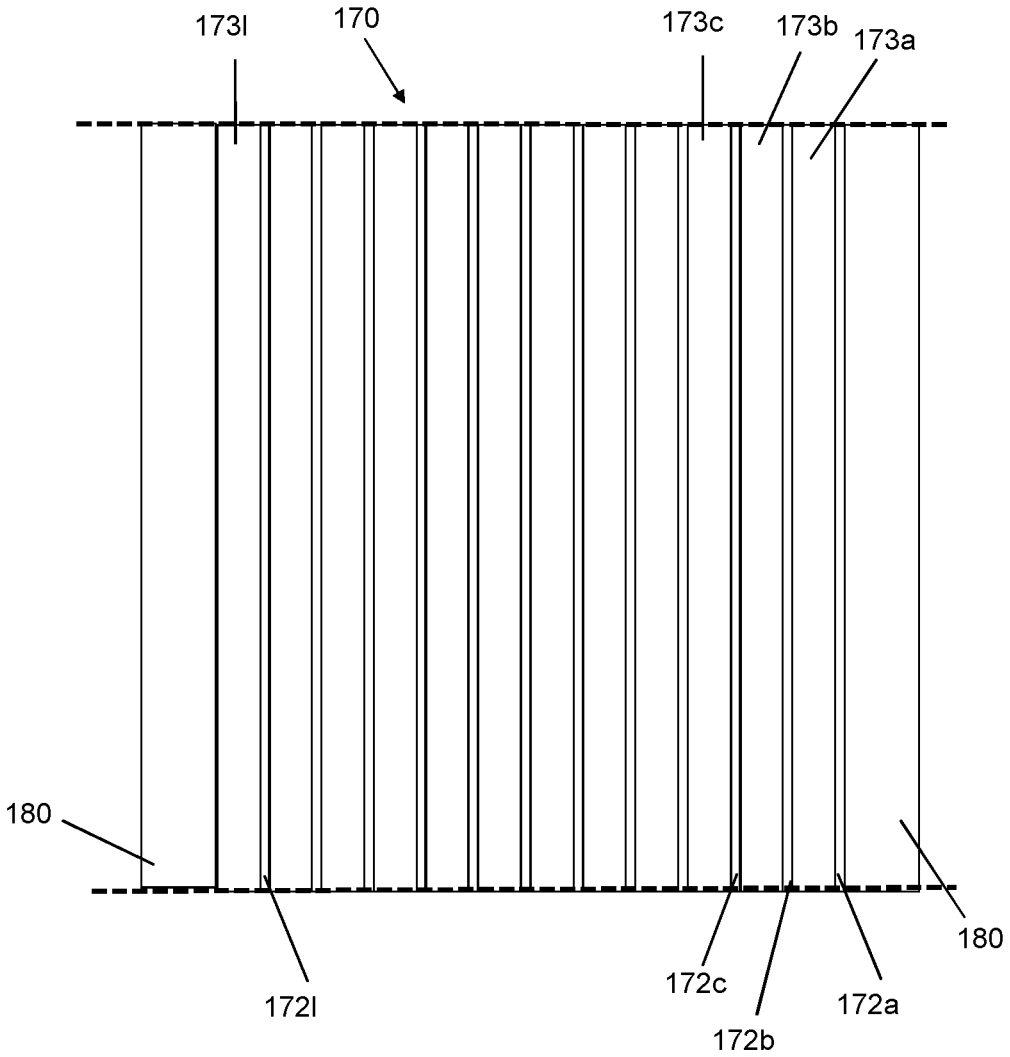
FIG. 1*d* shows a cross-sectional view through the protective shield of FIGS. 1*a* to 1*c;*

A cross-section through the shield 100 is shown in FIG. 1*d*, where a part of the composite structure 170 used in the structure is visible (for the sake of clarity, only a fraction of the height of the composite 170 is shown. The composite structure 170 comprises a plurality of graphene layers 172*a*, 172*b*, 172*c*, 172*l* and a plurality of aerogel layers 173*a*, 173*b*, 173*c*, 173*l*. The graphene layers 172*a-c,l* and the aerogel layers 173*a-c,l* alternative such that the composite structure 170 has a repeating structure of graphene layer/aerogel structure/graphene layer/aerogel layer. In this way, there is an outermost graphene layer 172*a* immediately adjacent the strike face 110, behind which is an aerogel layer 173*a*. This structure then repeats such that there is a second graphene layer 172*b* behind the first aerogel layer 173*a*, which is adjacent a second aerogel layer 173*b*, followed by a third set of layers 172*c*, 173*c*, which repeat until a final graphene layer 172*l* and a final aerogel layer 173*l*. Although not visible in FIG. 2, the layers 172*a-c,l* 173*a-c,l* of the structure 170 are bonded together by means of an adhesive which is provided between the layers. On either side of the composite structure is provided a cover layer 180, which forms the outermost layer defining the strike face 110 and the rear face 115 of the shield 100.

Figure 2:
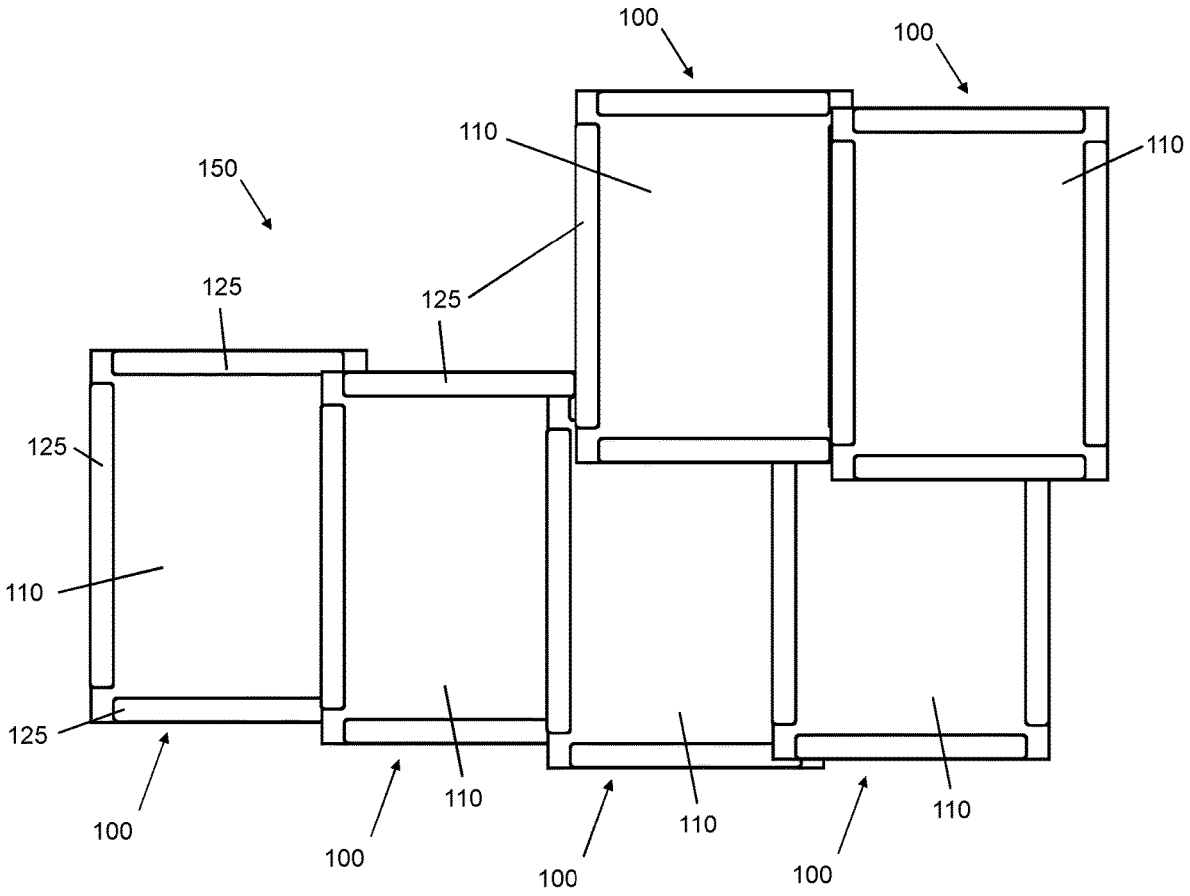
FIG. 2 shows a front view of a plurality of protective shields of FIGS. 1*a* to 1*c* in a shield wall according to an embodiment of the invention.
Figure 3:
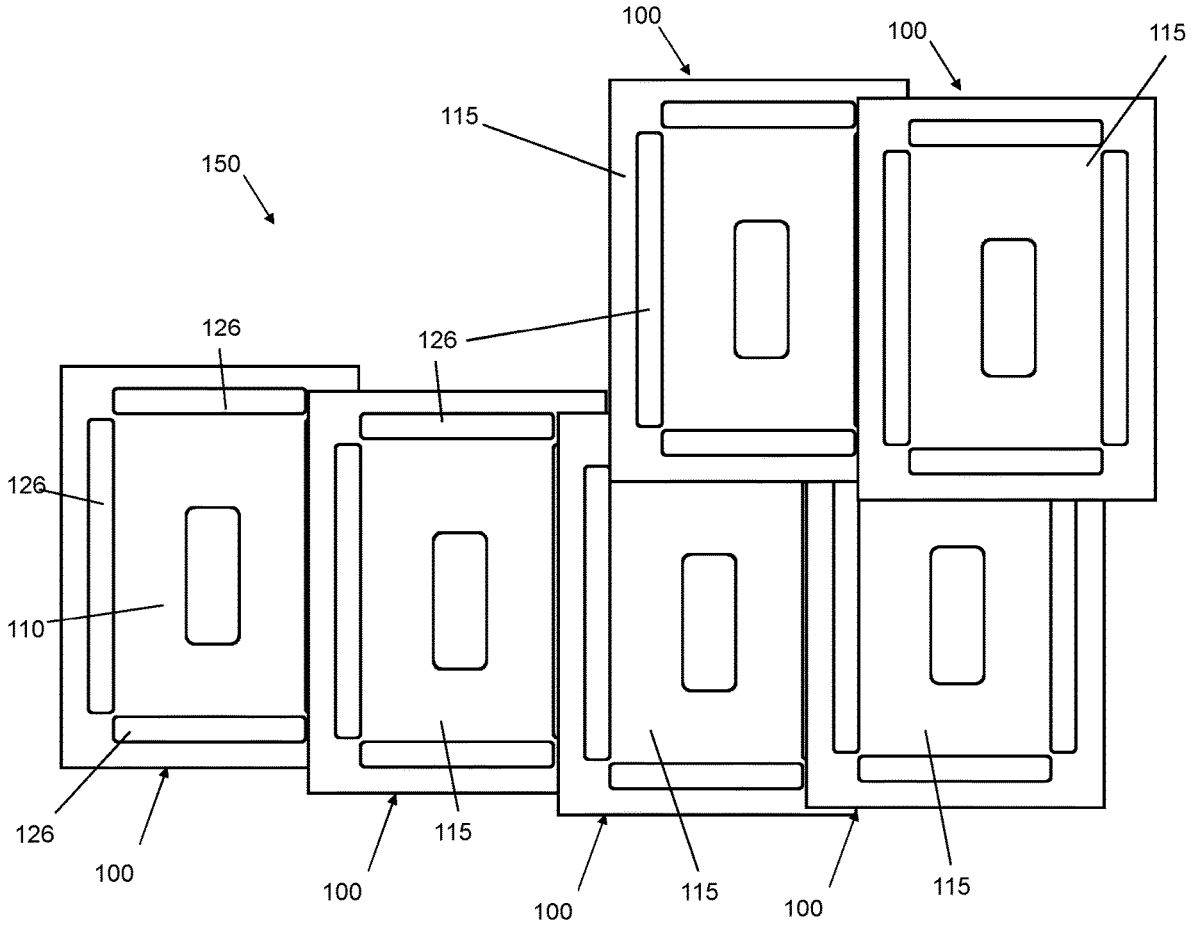
FIG. 3 shows a front view of a plurality of protective shields protective shields of FIGS. 1*a* to 1*c* in a shield wall according to an embodiment of the invention.

In use, multiple protective shields 100 can be used to form a protective shield wall 150, as shown in FIGS. 2 and 3, when required. In particular, a male connector strip 125 of the protective shield 100 can be connected to a female connector strip 126 of an adjacent protective shield 100 to thereby secure the protective shields 100 together along an edge 112. In this case, since the connector strips 125, 126 are both provided on the rear and front strike faces 115, 110, this creates an overlap of the strike faces 110 of the two protective shields 100 so as to create a continuous strike face, which ensures that adequate protection is provided. In other words, the bodies 105 of the adjacent protective shields 100 overlap. By virtue of the arrangement of the elongate connector strips 125, 126, the protective shield 100 can receive another protective shield 100 with the second protective shield 100 overlapping with any part of the perimeter of the protective shield 100. In particular, by virtue of the positioning of the elongate male connector strips 125, which extend over the majority of the length of the edges 111, 112, 113 and 114 and the arrangement of the elongate female connector strips 126, this leads to the overlap of the strike faces 110 so as to create the continuous strike face 110.

This interconnection can be continued by addition of further protective shields 100 to the protective shield wall 150, as shown in FIG. 2, where six protective shields 100 have been attached in this manner. In this case, a row of four protective shields 100 has been formed, with the elongate edges 112, 114 of the two protective shields 100 in the centre overlapping with the adjacent shields 100. A further two protective shields 100 have been added so as to overlap the top edges 111 of two of the other shields 100 in the wall 150 adding further protection. As can be seen from FIGS. 2 and 3, due to the arrangement of the connector strips 125, 126, the shields 100 can be arranged so that these do not need to be perfectly aligned and can be received at any part of the perimeter while still providing some degree of overlap of the strike faces 110. This makes the formation of the protective shield wall 150 easier in stressful situations.

This is particularly advantageous as the protective shields 100 can be carried individually or stored individually and then assembled into a wall 150 when required. For example, the individual shields 100 can be carried in a rucksack or backpack (for example, as a component part of the rucksack) and then it can be taken out of the rucksack and assembled into a wall 150 with other proactive shields 100.

The composite structure 170 in this embodiment is provided by forming a number of layers of aerogel substrate with graphene formed thereon and layering these into the composite structure 170. In this case, the graphene is disposed onto the aerogel substrate using the graphene in the form of an ink. This is achieved by dispersing graphene platelets in a solvent, applying the ink to the surface of the aerogel and removing the solvent to leave a layer of graphene platelets on the surface. This allows for the simple and relatively inexpensive application of a layer of graphene to the aerogel. Moreover, no further additives are required in the layer (e.g. a matrix). The presence of numerous layers of graphene and aerogel in repeating fashion in the composite structure 170 has been found to provide a particularly strong, yet still flexible, composite. Accordingly, the structure 170 is particularly useful for preventing penetration and absorbing impact as the presence of multiple discrete structures means that a failure of one aerogel layer (e.g. a fracture or breach) or protective layer will not necessarily result in failure of the structure, since there are other layers to absorb an impact. Further, a further effect has been observed whereby an increase in the number of layers leads to an increase in the effectiveness of the earlier layers in the structure.

Figure 4:
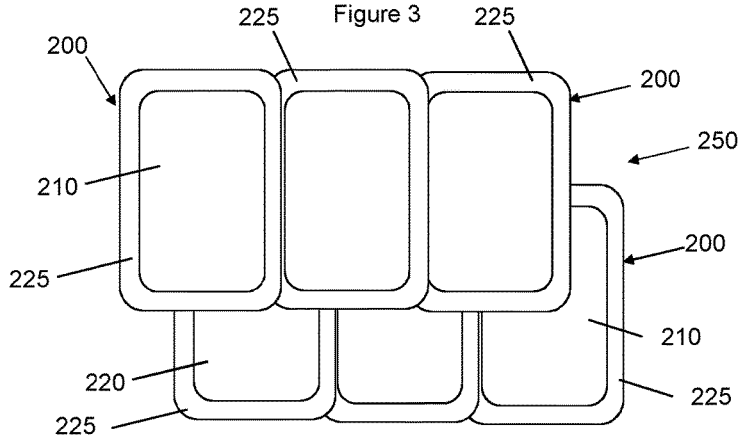
FIG. 4 shows a front view of a plurality of protective shields in a shield wall according to an embodiment of the invention.

Another embodiment is shown in FIG. 4, where there is a shield wall 250 comprising six flexible protective shields 200. Each shield 200 comprises a main body 210, in this case having a rounded cuboid shape, with a planar front strike face 210 and an opposing planar rear face (not visible). Between the strike face and the rear face 310 is a flexible composite structure (not visible), which serves to provide the impact protection. The shields 200 also comprise a connector arrangement in the form of a hook and loop (or hook and pile) releasable fastening arrangement (such as Velcro™), which comprises a first connector part in the form of a hook-containing connector element 225 provided on the strike face 210 and a second connector part in the form of a loop-containing connector element (not shown) provided on the rear face. The hook-containing connector element 225 in this case is an elongate strip which extends around the circumference of the strike face 210, adjacent the perimeter of the strike face 210. The loop-containing connector element is provided on the rear face and covers the entire surface of the rear face.

In this way, in use, the entire rear face of a first shield 200, which comprises the loop-containing connector element, can be pressed against the hook-containing connector 225 on the front strike face 210 of a second shield 200 to secure the first shield 200 and to create an overlap of the strike faces 210 and to form the protective shield wall 250. The arrangement and type of connector elements 225 used allows for the quick and straightforward connection of the shields 200. Moreover, the shape and arrangement is readily customisable to form a particular wall 250 suited to the particular need at the time the wall is assembled. Moreover, the connector arrangement makes it very straightforward and intuitive such that the wall 250 can be assembled under pressure and stress. The wall in this embodiment 250 is both strong and flexible shield wall 250 and thus can be adapted to cover a person or persons more completely.

Figure 5:
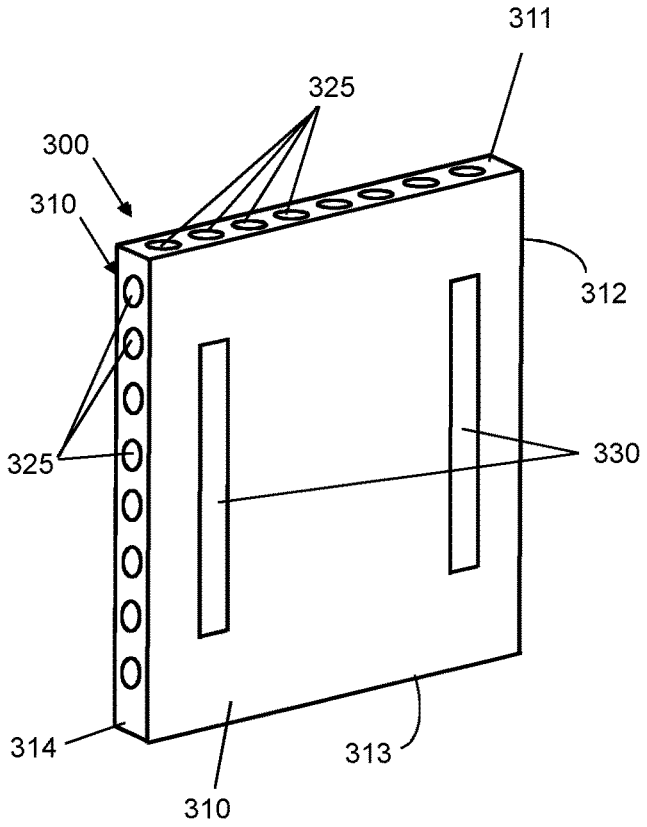
FIG. 5 shows a perspective view of a protective shield according to an embodiment of the invention.

Another embodiment is shown in FIG. 5, where there is a shield 300 comprising a cuboidal body 310 having a planar front strike face (not visible) and an opposing planar rear face 310. Between the strike face and the rear face 310 is a composite structure (not visible), which serves to provide the impact protection, and the strike face and rear face 310 are connected by four edges 311, 312, 313, 314. On the rear face 310 are two handles 330, which allow a user to grasp the shield 300 with the strike face facing away from the user. The shield 300 also comprises a connector arrangement, which consists of a series of pressure-sensitive adhesive spots 325 arranged in a space-apart array along each of the edges 311, 312, 313, 314, which are able to adhere to a second protective shield 300. In particular, these adhesive spots 325 can adhere to corresponding adhesive spots provided on the second protective shield 300 or to any other surface (e.g. the edges) of the second protective shield 300.

Figure 6:
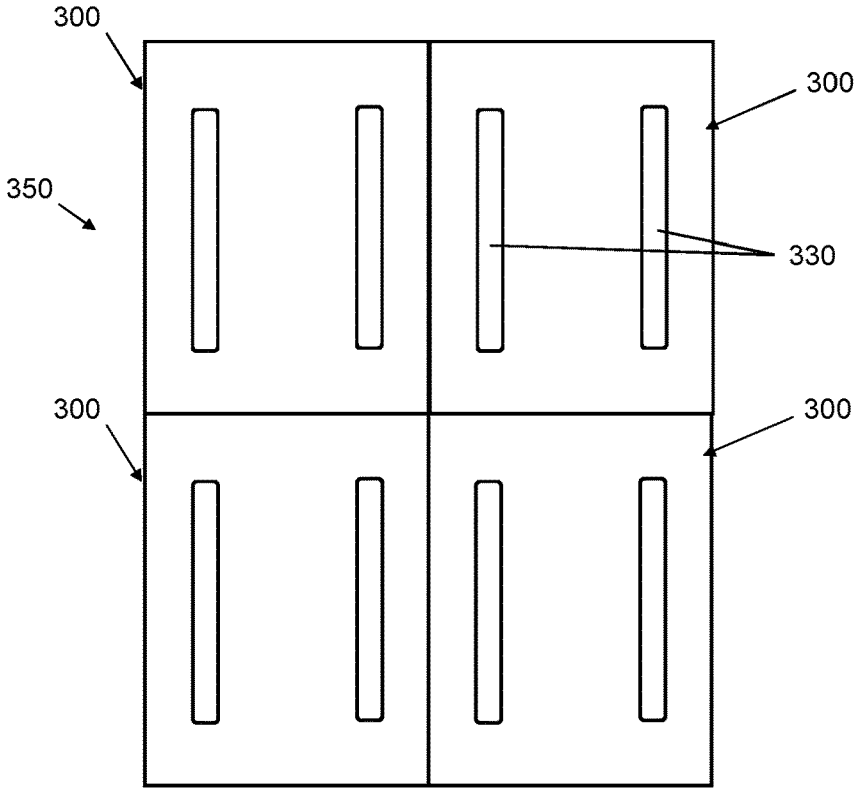
FIG. 6 shows rear view of a plurality of protective shields of FIG. 5 in a shield wall according to an embodiment of the invention.

Thus, in use, the shield 300 can be connected to other protective shields 300 to form a shield wall 350, as shown in FIG. 6. In particular, the shields 300 can be aligned and the edges 311, 312, 313, 314 pressed against one another to form a shield wall 350. In some cases, the adhesive spots 325 may be covered by a removable protective strip (not shown), which is removed prior to connection to adjacent shields 300. With the edges 311, 312, 313, 314 engaged with one another by virtue of the adhesive spots 325, the strike faces of the shields 300 abut one another to form a continuous strike face wall. This can then be used to protect a user, or multiple users.

Figure 7:
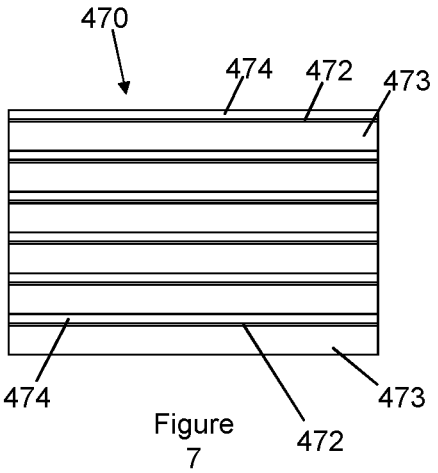
FIG. 7 shows a cross-sectional view of a composite structure for use in an embodiment of the invention.
Figure 8:
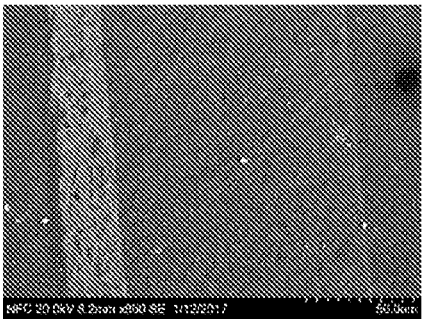
FIG. 8 shows an SEM image of an aerogel layer with a graphene layer disposed thereon at 650× magnification.
Figure 9:
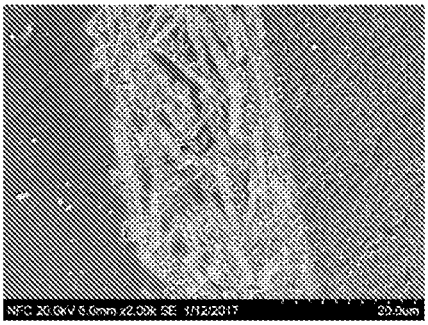
FIG. 9 shows an SEM image of an aerogel layer with a graphene layer disposed thereon at 2000× magnification.

As shown in FIG. 7, the composite structure 470 comprises alternating aerogel 473 and graphene 472 layers, but also includes a further set of protective layers 474 which are intermediate each pair of an aerogel 473 and a graphene 472 layer. Thus, the composite 470 has a repeating pattern of protective layer 474/graphene layer 472/aerogel layer 473. The protective layer 474 is a ballistic or penetration resistant high-tensile layer which provided on the top of the composite 470 and is located forward (i.e. in the direction of incoming impact force) of each of the graphene 472 and aerogel layers 472. The protective layer absorbs a portion of the impact and assists in preventing penetration through the structure. In a specific embodiment of the composite 470, the protective layer 474 of the composite structure 470 is an ultra-high molecular weight polyethylene (UHMWPE) layer having a thickness of 180 micrometres. The graphene layer 472 in this embodiment is a 20 micrometre thick layer of graphene platelets disposed on the aerogel layer 473. In this case, the graphene platelets are disposed onto each aerogel layer 473 using the graphene in the form of an ink. This is achieved by dispersing graphene platelets in a solvent, applying the ink to the surface of the aerogel and removing the solvent to leave a layer of graphene platelets on the surface. This allows for the simple and relatively inexpensive application of a layer of graphene to each aerogel layer 473. Moreover, no further additives are required in the layer (e.g. a matrix). The aerogel used in the aerogel layer 473 is a 125 micrometre thick layer of polyimide aerogel. The composite structure 470 can be arranged in the body of a protective shield with the uppermost protective layer 474 facing the strike face or as the strike face. FIGS. 8 and 9 show SEM images of a single layer of graphene platelets on a single layer of aerogel at 650× and 2000× magnification. Here the structure of the graphene platelets can be clearly seen. Using the methods disclosed herein a dense layer of graphene can be formed on the aerogel providing a strong, resilient cover or protective layer.

Figure 13:
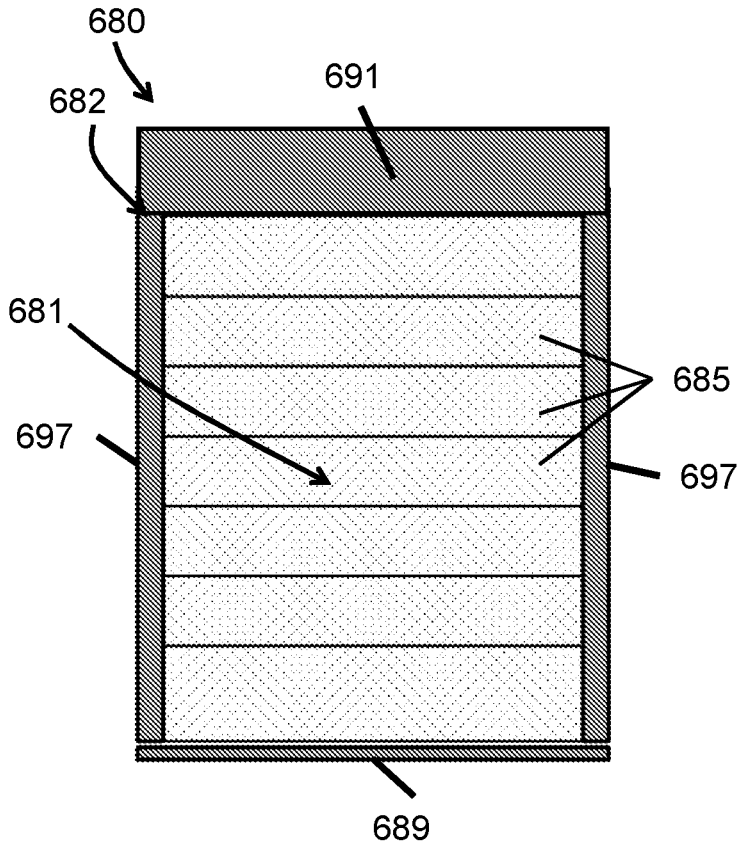
FIGS. 13 and 14 show front views of an embodiment of a shield wall assembly.
Figure 14:
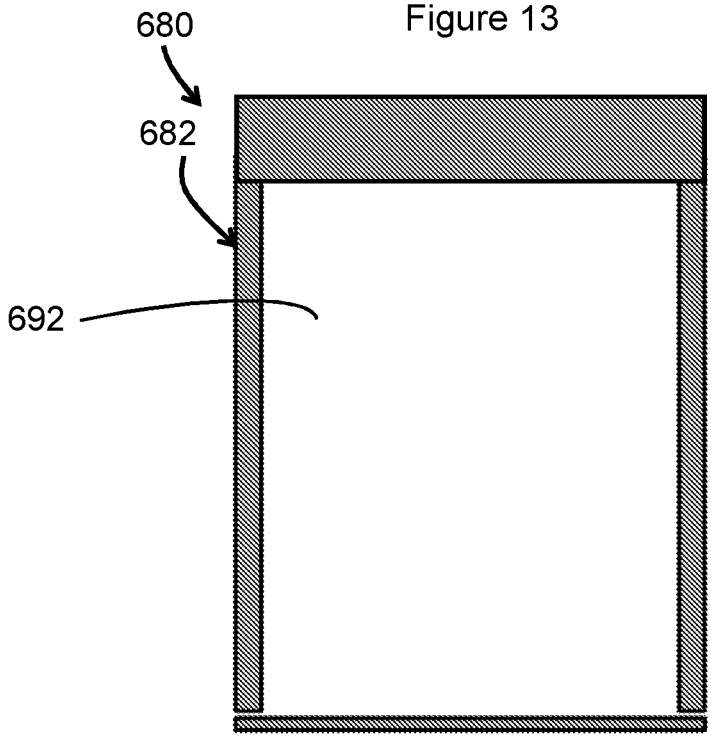

A deployable shield wall assembly 680 according to an embodiment of the invention is shown in FIGS. 13 to 16. As can be seen in FIG. 13, the deployable shield wall assembly 680 comprises a deployable shield wall 681 for providing protection from a projectile or impact and a frame 682 within which the deployable sidewall 681 is received. Frame 682 is defined by an upper member 691 of a holding element 690, which holding element 690 is connected to the deployable shield wall 681 at the top of the shield wall 681 thereby holding the shield wall 681 up, opposing vertically extending side members 697 and a lower member 689. In this embodiment, the frame 682 has a rectangular shape with a central opening or void 692, within which the shield wall 681 can be received. As will be set out in more detail below, the deployable shield wall 681 can be deployed between a retracted configuration (shown in FIG. 14) in which it is not received within the opening 692 and a deployed configuration (shown in FIG. 13) in which it is fully received within the opening 692 so as to provide protection from a projectile or impact.

Figure 15:
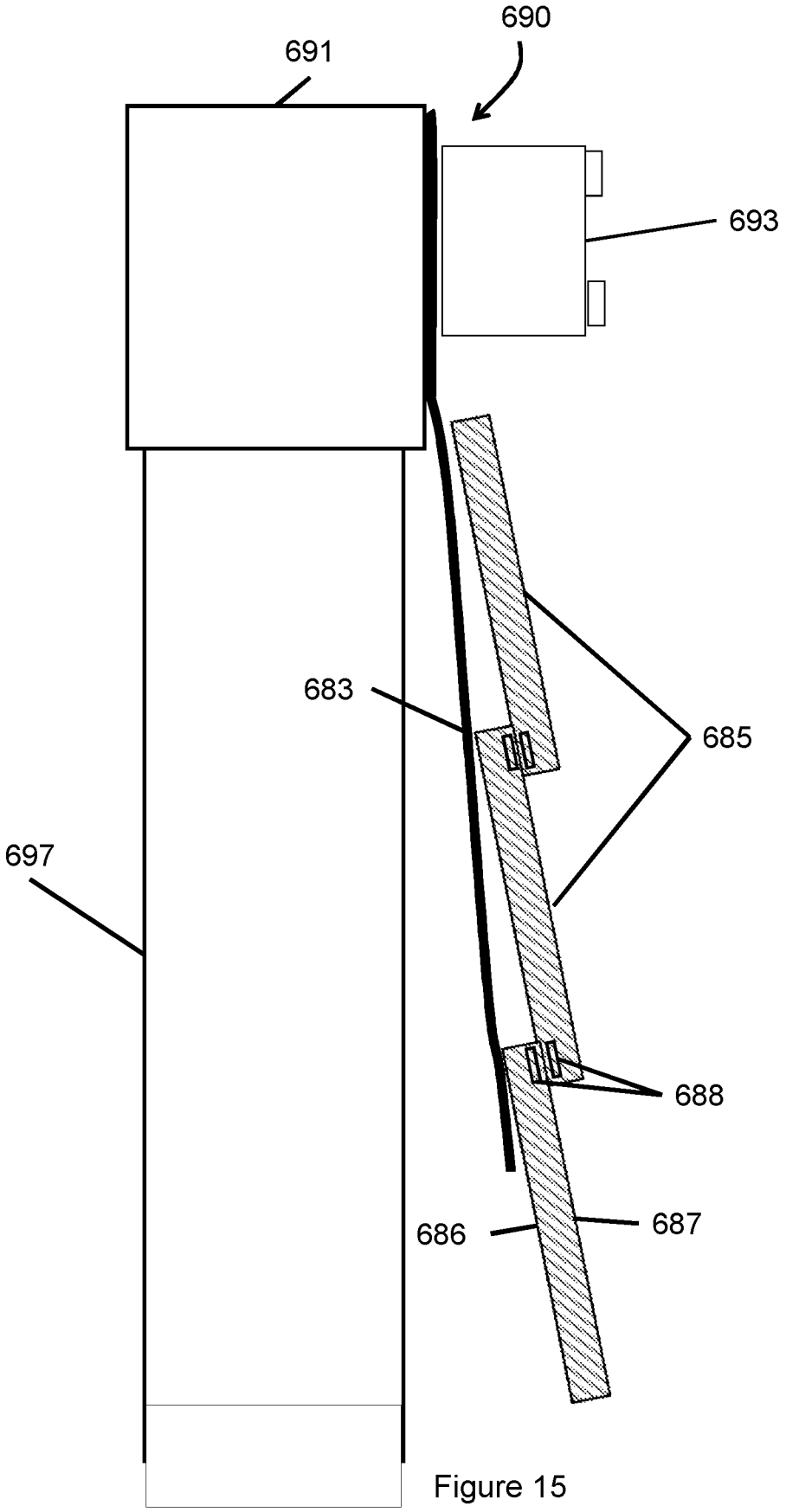
FIGS. 15 and 16 show side views of the embodiment of FIGS. 13 and 14.
Figure 16:
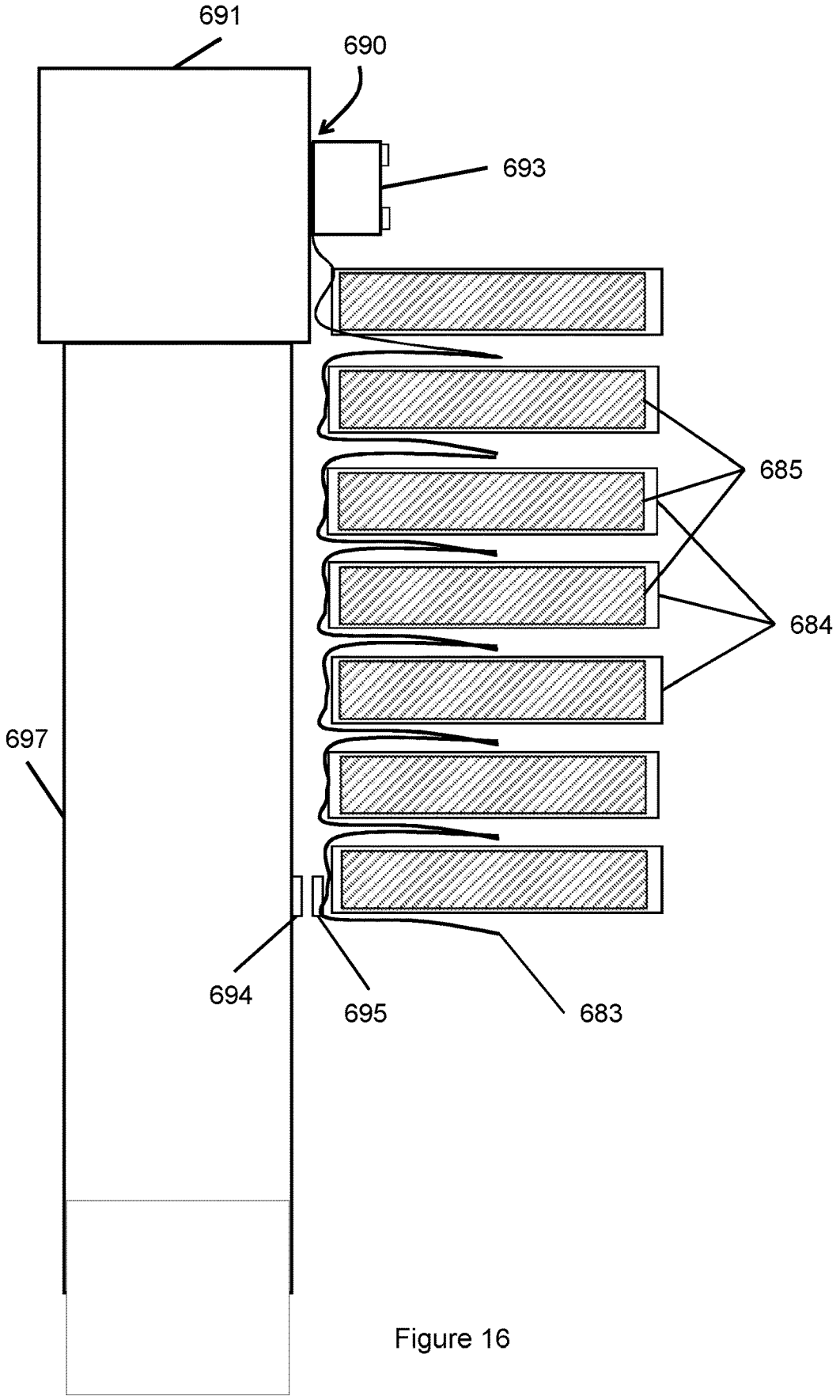

The deployable shield wall 681, which can be seen more clearly in FIGS. 13, 15 and 16, comprises a penetration-resistant support screen 683, several shield members 685, each of which comprises a composite structure and is attached to the support screen 683. The shield members each also comprise a pair of fastening elements 688 for providing further structure to the wall 681 when in a deployed configuration. Here, fastening elements 688 are placed on the side edges of the deployable shield wall 681. Each shield member 685 also comprises two fastening elements 688, one located at the uppermost edge of the shield member 685 and the other located at the lowermost edge such that the fastening devices 688 are within the overlap portion of the shield members 685.

The support screen 683 is formed of a continuous sheet of ballistic fabric; in this case, the ballistic fabric is formed of woven ultra-high molecular weight polyethylene (UHMWPE) which is both cut and stab-proof. The penetration-resistant support screen 683 comprises multiple pockets 684 on its rear surface for receiving the shield members 685. In this embodiment, multiple pockets 684 are arranged vertically along the length of the penetration-resistant support screen 683, with each of the pockets 684 extending the entire width of the penetration-resistant support screen 683. The pockets 684 are secured to the penetration-resistant support screen 683 along their upper edge such that a given pocket 684 and shield member 685 combination is able to pivot away from the penetration-resistant support screen 683 about this upper edge. The pockets 684 entirely encapsulate their corresponding shield members 685 such that the shield members 685 cannot be removed without opening the pockets 684 first.

The shield members 685 of the deployable shield wall 681 each have a front strike face 686 and a rear opposing face 687, with the composite structure arranged in layers defining and extending parallel to these faces 686, 687, as will be explained below in more detail. This configuration allows for maximum ballistic performance when the strike face is oriented towards an oncoming projectile. For the purposes of clarity, in this embodiment the strike or front face 686 is the face of a given panel 685 which is oriented towards the penetration-resistant support screen 683 when in its deployed configuration; similarly, the opposing face or rear face 687 is the opposite face of the panel 685. The composite structure of the shield member 685 in this embodiment can be the same as set out in respect of the earlier embodiments, such as that of FIG. 7.

As set out above, the frame 682 is defined by holding element 690 opposing vertically extending side members 697 and a lower member 689. In this embodiment, lower member 689 and side members 697 are formed from hardened steel and are connected together, and with the holding element 690, to provide a rigid, self-supporting frame 682. As is visible in the front view of FIG. 13, the lower member 689 has a smaller profile than the remaining members such that it does not disrupt passage through the central opening 692, thereby allowing the assembly 690 to be placed in a doorway, for example. Although not shown, lower member 689 includes an engagement element (not shown) adapted to engage with the lower edge of the shield member In this embodiment, the deployable shield wall 681 is attached, at the uppermost point of the penetration-resistant support screen 683, the holding element 690 such that it hangs from this point when deployed. In particular, the upper edge of the support screen 683 is retained between the upper member 691 and a clamping member 693. The clamping member 693 is an elongate member which extends along the length of the upper member 691 so as to allow for equal pressure to be applied across the clamped area of the penetration-resistant support screen 683 thus minimising the risk of tearing or other failure. The clamping member 693 also allows for the deployable shield wall 681 to be easily replaced as a complete unit, for example after damage from a projectile or impact. Security fasteners (not shown) are used such that the clamping member 693 can only be released by an authorised person.

The holding element 690 also comprises a deployment mechanism in the form of a release mechanism. The release mechanism comprises two releasable catches 694 (only one is visible in FIG. 16), each of which is located near a top of each side member 697 of the frame 682. Each catch 694 engages an engagement element 695 located at the bottom of corresponding side edges of the deployable shield wall 681 when the wall 681 is in its retracted configuration. The catches 694 are operatively connected to a controller (not shown) which is arranged to release the catches upon detection of an event (e.g. an alarm or manual trigger). The catches 694 are also configured such that they automatically engage when the shield wall 681 is retracted after use, i.e. moves the wall 681 from its deployed configuration into its retracted configuration. Suitable catches 694 and engagement elements 695 include manual latches or electromagnetic catches, for example.

The deployable shield wall 681 is shown in its retracted configuration in FIG. 16. As can be seen, the penetration-resistant support screen 683 and shield members 685 are in a collapsed state in which they are folded together into a compact arrangement wherein the shield members 685 are stacked together and parallel to one another such that the strike face of one shield member 685 directly faces the opposing rear face of the shield member 685 below it; folds of the penetration-resistant support screen 683 itself lie partially in the gaps between these faces. In this figure, the pockets 684 are shown but their upper edge connections are not.

The deployable shield wall 681 is shown in its deployed configuration in FIG. 15. Here, the composite shield members 685 are in an expanded state and effectively form a continuous strike barrier behind the penetration-resistant support screen 683; in other words, at any point of the penetration-resistant support screen 683 there is at least one shield member directly or indirectly (i.e. with the presence of an air gap) behind the penetration-resistant support screen 683, such that the deployable shield wall 681 has few or no points of weakness. The shield members 685 are configured to overlap with one another such that at certain points of the penetration-resistant support screen 683, there are two shield members 685 behind the penetration-resistant support screen 683. In particular, the lowermost portion of the strike face 686 of one shield member will lie against the uppermost portion of the opposing face 687 of the shield member 685 directly below it. In this embodiment, approximately 5 cm of the upper shield member overlaps the shield member directly below it. This is advantageous, as the joints between shield members 685 which may otherwise be a weak point, are reinforced.

The deployable shield wall 681 is sized such that when it is deployed, the shield wall 681 covers the entirety of the central opening 692 of the holding element 690. In this embodiment, the deployable shield wall 681 overlaps each of the side members 697 and the upper member 690.

In use, the deployable shield wall 681 is initially collapsed in its retracted configuration. In response to a perceived threat, the release mechanism can be operated (either manually, or automatically, depending on the control system used), thereby releasing the catches 694 and deploying the shield wall 681. As the shield wall 681 is released, it falls under the force over gravity. This moves the shield wall 681 from its retracted configuration wherein the shield members 685 are stacked parallel to one another in the collapsed state and into its deployed configuration wherein the shield members 685 overlap one another. On moving into its deployed configuration, the fastening devices located on the shield members 685 engage such that each shield member is secured to its adjacent shield members 685. This means that the shield members 685 are rigidly connected to one another. In addition, the engagement element provided on the lower member 689 also engages with the lower edge of the shield wall 681. This ensures that significant force is required to move the wall 681 away from the frame 682.

In this position, the shield wall 681 provides a barrier through the opening 692 thereby protecting people or objections on either side of the barrier, but particularly behind the rear face, from threats, such as projectiles (e.g. bullets) or impacts (e.g. blunt force or bladed weapons). Moreover, the shield wall 681 acts as a barrier to prevent passage therethrough. The assembly can thus be placed in any opening such as a doorway or across a room to provide quick and safe protection in the case of a threat. In some embodiments, the lower member 689 of the frame 682 can be recessing into the floor or ground. This is advantageous in that access through the central opening 692 is improved.

When the threat is over, the shield wall 681 can be retracted. In this embodiment, the shield wall 681 can be disengaged from the engagement element of the lower member 689 and fastening elements 688 can be disengaged. The shield wall 681 can be collapsed back into the state shown in FIG. 16 and reattached to catch 694. The deployable shield wall 681 can then be re-used assuming it is not damaged. Should the shield wall 681 have been damaged to the point where replacement is recommended, the shield wall 681 can then be released from the clamping member 693 and replaced. In view of the lightweight nature of the composite structure used in shield members 685 and the simplicity of the release mechanism and design of the assembly, this replacement can easily be carried out.

The above embodiment is purely for the purposes of demonstrating how an implementation of the invention could be provided. Other embodiments are possible. Modifications include, for example:

In other embodiments, the fastening devices 688, catches 694, engagement elements 695 and engagement element on the lower member 689 could be electromagnet fastening devices. In some embodiments, the side edges and lower edges of the shield wall 681 may be provided with are electromagnets configured to engage the corresponding side members 697 or the other way around. In some embodiments, the fastening devices 688 placed on each shield member are located and configured to engage the side members 697 of the frame 682, through the penetration-resistant support screen 683. This configuration is advantageous as the fastening devices can hold both the penetration-resistant support screen 683 and individual shield members 685 securely to the holding element 690. However, both the penetration-resistant support screen 683 and shield members 685 can comprise fastening devices in some embodiments.

Figure 17:
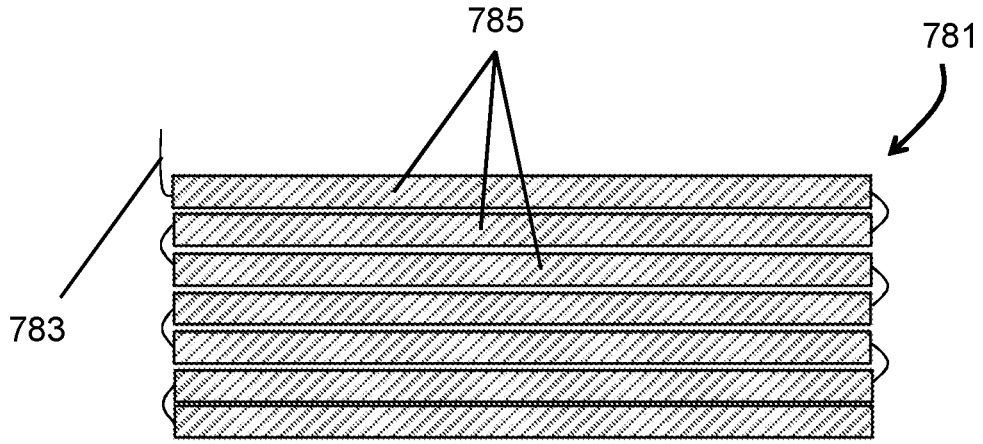
FIGS. 17 and 18 show shield walls for use in an embodiment of a shield wall assembly.

A further embodiment of a shield wall 781 is shown in FIG. 17. This shield wall 781 is shown in isolation to a shield wall assembly, but could be employed in the shield wall assembly 681 of FIGS. 13 to 16 or as part of any other shield wall assembly according to the invention. In the embodiment of FIG. 17, the shield wall 781 comprises a plurality of shield members 785 which do not overlap each other, but are instead sized so that when in a deployed configuration the top shield member 785 meets the bottom of an adjacent shield member 785 (i.e. abuts the adjacent shield member 785). Without overlap, there is less interaction between the shield members 785 such that the wall 781 can more easily be stored in a rolled configuration rather than the stacked configuration of the embodiment of FIGS. 13 to 16. Moreover, the shield members 785 are attached to a penetration-resistant support screen 783 about their entire periphery, rather than only the upper edge as in the aforementioned embodiment; because of this, the shield members 785 maintain their positions relative to the penetration-resistant support screen 783 without any fastening devices 688 therebetween. It will be appreciated that the shield members 785 of this shield wall 781 could also be stacked as in the earlier embodiment, as shown in FIG. 17.

Figure 18:
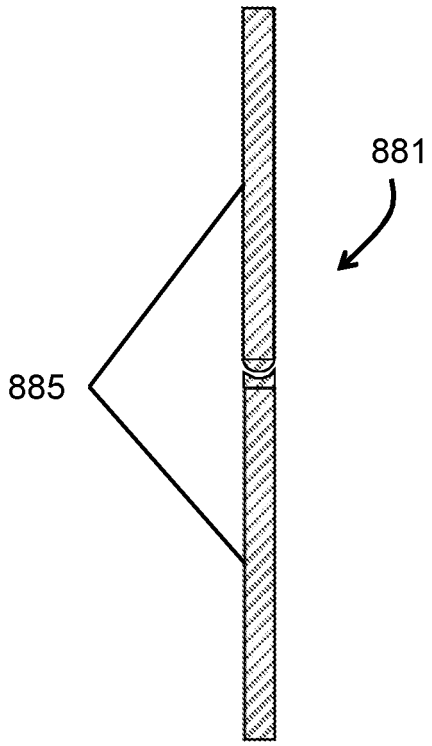

A further development of the embodiment of FIG. 17 is shown in FIG. 18, in which there are two shield members 885 making up a shield wall 881. In this embodiment, the edges of the shield members 885 are complimentary. In particular, the bottom of the upper shield member 885 is shaped so as to correspond to the top of the shield member 885 directly below it. In the embodiment shown in FIG. 18, a ball and cup design is shown. This design may provide improved ballistic performance at the joints between shield members 885.

Although shown with a frame, such a frame is not necessary. For example, the holding element may be suspended by attaching to a ceiling or another surface. Alternatively, the holding element may be located on the floor and the shield wall deployed sideways or vertically upwards.

EXAMPLES

Specific examples of composite structures that are used in the shields and shield walls of the invention are provided below:

Example 1

A 125 μm flexible polyimide aerogel layer (AeroZero 125 micrometer polyimide aerogel film; BlueShift Inc (US)) was cut to size and coated with a 20 μm layer of a polyurethane (PX30; Xencast UK Flexible Series PU Resin system. Manufacturer reported properties: Hardness of 30-35 (Shore A); Tensile strength 0.7-1.2 MPa; Elongation 100-155% at break; Tear Strength 3.5-3.8 kN/m) using a slot die process. After coating, the polyurethane layer was left to cure at room temperature for 12 hours. The aerogel/polyurethane composite layer (backing structure) was then cut to size.

An ultra-high molecular weight polyethylene (UHMWPE) fabric (Spectra 1000; 200D; Honeywell; 80 gsm; Warp Yarn 24 Tex; Weft Yarn 25 Tex; Encs×Picks/10 cm 177×177; Plain Weave) was cut to the same size as the backing structure and was applied to the upper surface of the backing structure (i.e. the exposed surface of the polyurethane layer).

The laminate structure was then further built up by adding additional, alternating layers of the backing structure (i.e. the combined aerogel/polyurethane layers) and UHMWPE fabric to form a multi-layered composite. In particular, an additional backing structure layer (i.e. the aerogel layer and the polyurethane layer in combination) was then applied to the top of the first UHMWPE fabric layer with the aerogel layer of the additional backing structure layer being applied to the UHMWPE fabric layer. An additional UHMWPE fabric layer was then applied to the top of the second backing structure. This process was repeated to provide a multi-layered composite comprising 60 alternating layers of aerogel/polyurethane and UHMWPE (i.e. 30 backing structures and 30 UHMWPE layers).

This laminate structure was both flexible and lightweight and therefore can be incorporated into body armour. The laminate structure also provided effective protection against damage from a knife impact by absorbing the force of the impact and preventing penetration of the knife through the laminate structure.

Example 2

A 125 μm flexible polyimide aerogel layer (AeroZero 125 micrometer polyimide aerogel film; BlueShift Inc (US)) was cut to size and coated with a 20 μm layer of graphene (Elicarb graphene powder; Thomas Swan & Co Ltd UK Product No. PR0953) in a polyurethane matrix (PX30; Xencast UK Flexible Series PU Resin system. Manufacturer reported properties: Hardness of 30-35 (Shore A); Tensile strength 0.7-1.2 MPa; Elongation 100-155% at break; Tear Strength 3.5-3.8 kN/m) using a slot die process. After coating, the graphene/polyurethane layer was left to cure and subsequently cut to size.

The graphene/polyurethane layer comprised 5 wt % functionalised graphene (Elicarb graphene powder; Thomas Swan & Co Ltd UK Product No. PR0953), which was dispersed in the polyurethane prior to slot die processing. More specifically, prior to dispersion, the graphene was treated with a plasma treatment of "oxygen" functionalisation using the Hydale HDLPAS process, which is set out in WO 2010/142953 A1 (alternatively, plasma functionalised graphene nanoplatelets are commercially available from Hydale "HDPLAS GNP" e.g. HDPlas GNP-$O_2$ or HDPLAS GNP—COOH). Following treatment, the graphene and polyurethane are premixed in a planetary centrifugal mixer and the resin was degassed under vacuum to remove air bubbles. The mixture was then passed through a dispersion stage using a Three Roll mill (at 40° C. with a <5 μm gap) and with eight passes. The graphene/polyurethane mixture was then mixed with a hardener, followed by subsequent degassing using a planetary centrifugal mixer.

Once the graphene/polyurethane mixture was created it was layered down onto a polypropylene sheet with a 20 μm drawdown wire rod (which regulates the thickness to 20 μm). After the layering down has been completed, the layer was left to dry out. However, before the graphene/polyurethane layer fully cures, the aerogel is stuck onto the layer so as to bond the layers together. The combined layers making up the structure were then left to cure for 24 hours, and after which the combined layer of aerogel and the polyurethane/graphene resin mixture was cut into shape.

An ultra-high molecular weight polyethylene (UHMWPE) fabric (Spectra 1000; 200D; Honeywell; 80 gsm; Warp Yarn 24 Tex; Weft Yarn 25 Tex; Encs×Picks/10 cm 177×177; Plain Weave) was cut to the same size as the backing structure and was applied to the upper surface of the backing structure (i.e. the exposed surface of the polyurethane layer).

The composite structure was then further built up by adding additional, alternating layers of the graphene layers and aerogel layers, together with UHMWPE fabric between each pair of graphene and aerogel layers to form a multi-layered composite. This process was repeated to provide a multi-layered composite comprising 90 layers comprising 30 aerogel layers, 30 graphene/polyurethane layers and 30 UHMWPE layers with the repeating structure: UHMWPE/graphene layer/aerogel layer. The layers of the composite were bonded together.

This composite structure was both flexible and lightweight and therefore can be incorporated into body armour. The composite structure also provided effective protection against damage from a knife impact by absorbing the force of the impact and preventing penetration of the knife through the composite structure.

Example 3

Using the techniques described in respect of Examples 1 and 2, above, a composite structure comprising 26 layers of UHMWPE fibre (DOYENTRONTEX Bulletproof unidirectional sheet; WB-674; 160 g/$m^2$; 0.21 mm thickness) alternating with 25 layers of backing structure was prepared. The backing structure comprised 125 μm flexible polyimide aerogel (AeroZero 125 micrometer film from BlueShift Inc (US)) layered with a 20 μm layer of a polyurethane (PX60; Xencast UK) (i.e. 25 layers of aerogel alternating with 25 layers of polyurethane). In this Example, the polyurethane was infused with 0.2% graphene (Elicarb graphene powder; Thomas Swan & Co Ltd UK Product No. PR0953) using the technique set out in respect of Example 2. Thus, the composite had the following repeating pattern arrangement of layers " . . . UHMWPE layer/polyurethane+graphene layer/aerogel layer/UHMWPE layer/polyurethane+graphene layer/aerogel layer . . . ".

Example 4

Using the techniques described in respect of Examples 1 and 2, above, a composite structure comprising 26 layers of UHMWPE fabric (Spectra 1000; 200D; Honeywell; 80 gsm; Warp Yarn 24 Tex; Weft Yarn 25 Tex; Encs×Picks/10 cm 177×177; Plain Weave), 25 layers of 125 μm flexible polyimide aerogel (AeroZero 125 micrometer film from BlueShift Inc (US)) and 25 layers of a 20 μm layer of a polyurethane (PX60; Xencast UK) doped with 1% graphene (Elicarb graphene powder; Thomas Swan & Co Ltd UK Product No. PR0953). Thus, the laminate had the following repeating pattern arrangement of layers " . . . UHMWPE layer/polyurethane+graphene layer/aerogel layer/UHMWPE layer/polyurethane+graphene layer/aerogel layer . . . ".

Example 5

Another composite structure comprises a repeating structure comprising an aerogel film (125 μm flexible polyimide aerogel; AeroZero 125 micrometer film from BlueShift Inc (US)), a graphene particle infused epoxy (Elicarb graphene powder; Thomas Swan & Co Ltd UK Product No. PR0953) and a high-tensile polyoxymethylene (POM) layer (Delrin). Thus, the composite structure has a sub-unit of aerogel/graphene-infused epoxy/POM which repeats throughout the structure to form a composite having alternating graphene and aerogel containing layers.

The composite structure 1101 is manufactured by firstly functionalising the graphene nanoplatelets in a Haydale plasma reactor (using a carboxyl process) and subsequently dispersing the graphene nanoplatelets in a flexible epoxy. The graphene/epoxy mixture was subsequently slot die coated onto the Aerogel film and then layered with the POM layer (in the form of a fabric). This sub-unit is then vacuum-cured at room temperature. The structure was then built up by bonding multiple sub-units together on top of one another to form the composite structure. In this way, an aerogel layer of one sub-unit was bonded to a POM layer of an adjacent sub-unit. Furthermore, the lowermost sub-unit of the composite structure was provided with a POM layer on its underside so that POM layers form the uppermost and lowermost layers.

The composite structure was flexible, strong and light.

Example 6

A composite structure comprising of 12 individual sets of sub-structures layered on top of one another was prepared, each sub-structure comprising 9 layers of UHMWPE fibre (DOYENTRONTEX Bulletproof unidirectional sheet; WB-674; 160 g/m$^2$; 0.21 mm thickness) on top of 9 layers of 125 μm flexible polyimide aerogel (AeroZero 125 micrometer film from BlueShift Inc (US)) layered with a graphene layer. The graphene layer was formed by an inking technique.

In particular, a graphene-containing ink (LTR4905; Heraeus Noblelight Ltd) was used to form the graphene layer. The graphene-containing ink was a combination of 4-hydroxy-4-methylpentan-2-one and dipropylene glycol monomethyl ether as solvent and carrier, with 20 weight % graphene loading. The graphene in the ink is Perpetuus graphene with 15 μm lateral flake size and had been functionalised using amine species.

The ink was applied to the surface of the aerogel using a 6 μm k-bar (K hand coater; Testing Machines, Inc.). It is thought that the shear rates associated with the application of the ink on the aerogel aligns the graphene flakes parallel to the aerogel surface. As the layer dries, the solvent evaporates leaving a final layer thickness of 2 to 3 μm. It is thought that the solvent evaporation leads to further alignment of the graphene platelets parallel to the aerogel surface. The ink is subsequently heat treated at 125° C. for 10 minutes to drive off remaining solvent and to harden the polymer. This left a layer of graphene platelets on the surface. Thus, the composite had the following arrangement of layers " . . . UHMWPE layer/UHMWPE layer/UHMWPE layer/graphene layer/aerogel layer/graphene layer/aerogel layer/graphene layer/aerogel layer . . . " with 12 repeat units or sub-sets.

The composite structure, which had a width of 25 cm and a height of 18 cm, was placed inside a bag made from UHMWPE fabric, the bag comprising a handle on one face and hook and loop fastenings on both the major front and rear surfaces to form a connector arrangement. The composite structure and the shield were flexible, strong and light.

Example 7

Using the techniques described in respect of the Examples above, a composite structure comprising five UHMWPE layers (UHMWPE fabric (Spectra 1000; 200D; Honeywell; 80 gsm; Warp Yarn 24 Tex; Weft Yarn 25 Tex; Encs×Picks/10 cm 177×177; Plain Weave)) alternating with five backing layers (five layers of 1% graphene platelet doped polyurethane layers, prepared as set out in the previous examples, and five layers of 125 μm flexible polyimide aerogel (AeroZero 125 micrometer film from BlueShift Inc (US)). The laminate structure also comprised a crocheted swatch of 1.0 mm UHMWPE braided thread (see FIG. 9 and accompanying description) with UHMWPE thread whipping around the tile edges to improve performance. The test results showed no penetration in a stab test and only a minimal dent in a plasticine clay-bed, which is significantly better than commercially available standards.

Example 8

A composite structure comprising of 6 individual sets of sub-structures layered on top of one another was prepared, each sub-structure comprising 9 layers of UHMWPE fibre (DOYENTRONTEX Bulletproof unidirectional sheet; WB-674; 160 g/m$^2$; 0.21 mm thickness) on top of 9 layers of 125 μm flexible polyimide aerogel (AeroZero 125 micrometer film from BlueShift Inc (US)) layered with a graphene layer. The graphene layer was formed by the inking method described above in respect of Example 6. In particular, a graphene-containing ink (LTR4905; Heraeus Noblelight Ltd) was used to form the graphene layer by applying the ink to the surface of the aerogel, as set out in respect of Example 6. Thus, the composite had the following arrangement of layers " . . . UHMWPE layer/UHMWPE layer/UHMWPE layer/graphene layer/aerogel layer/graphene layer/aerogel layer/graphene layer/aerogel layer . . . " which repeats 6 times. An additional set of 9 layers of UHMWPE fibre (DOYENTRONTEX Bulletproof unidirectional sheet; WB-674; 160 g/m$^2$; 0.21 mm thickness) was provided on the base of the composite structure (below the final set of graphene/aerogel layers).

The composite structure was flexible, strong and lightweight. For testing purposes, the composite was placed into a pocket made from UHMWPE fibres, which can be seen in FIGS. 11*a* and 11*b*.

Example 9

Using the techniques described in respect of the Examples above, a laminate structure comprising 52 layers of UHMWPE fabric (Spectra 1000; 200D; Honeywell; 80 gsm; Warp Yarn 24 Tex; Weft Yarn 25 Tex; Encs×Picks/10 cm 177×177; Plain Weave) alternating with 51 layers of a backing structure was prepared. The backing structure comprised 125 μm flexible polyimide aerogel (AeroZero 125 micrometer film from BlueShift Inc (US)) layered with a 20 μm layer of a polyurethane (PX60; Xencast UK Flexible Series PU Resin system. Manufacturer reported: Hardness of 60-65 (Shore A); Tensile strength 3.4-3.8 MPa; Elongation 200-260% at break; Tear Strength 19.0-23.0 kN/m) (i.e. 51 layers of aerogel alternating with 51 layers of polyurethane). Thus, the laminate had the following repeating pattern arrangement of layers " . . . UHMWPE layer/polyurethane layer/aerogel layer/UHMWPE layer/polyurethane layer/aerogel layer . . . ".

Example 10

Using the techniques described in respect of the Examples above, a laminate structure comprising a stack of 52 layers of UHMWPE fabric (Spectra 1000; 200D; Honeywell; 80 gsm; Warp Yarn 24 Tex; Weft Yarn 25 Tex; Encs×Picks/10 cm 177×177; Plain Weave) and a stack of 51 backing structures was prepared. The laminate structure thus comprised 52 layers of UHMWPE fabric followed by 51 backing structures. Each backing structure comprised 125 μm flexible polyimide aerogel (AeroZero 125 micrometer film from BlueShift Inc (US)) layered with a 20 μm layer of a polyurethane (PX60; Xencast UK). Thus, the laminate had the following pattern arrangement of layers "UHMWPE layer/UHMWPE layer . . . UHMWPE layer/UHMWPE layer/polyurethane layer/aerogel layer/polyurethane layer/aerogel layer . . . polyurethane layer/aerogel layer". Example 10 therefore differs from Example 9 by virtue of the order of the protective layer and the backing structures.

Example 11

Using the techniques described in respect of the Examples above, a laminate structure comprising 26 layers of UHMWPE fabric (Spectra 1000; 200D; Honeywell; 80 gsm; Warp Yarn 24 Tex; Weft Yarn 25 Tex; Encs×Picks/10 cm 177×177; Plain Weave) alternating with 25 layers of a backing structure was prepared. The backing structure comprised 125 μm flexible polyimide aerogel (AeroZero 125 micrometer film from BlueShift Inc (US)) layered with a 20 μm layer of a polyurethane (PX60; Xencast UK) (i.e. 25 layers of aerogel alternating with 25 layers of polyurethane). Thus, the laminate had the following repeating pattern arrangement of layers " . . . UHMWPE layer/polyurethane layer/aerogel layer/UHMWPE layer/polyurethane layer/aerogel layer . . . ".

Example 12

Using the techniques described in respect of the Examples above, a laminate structure comprising 51 layers of a front structure on top of 52 layers of a protective backing layer (UHMWPE fabric (Spectra 1000; 200D; Honeywell; 80 gsm; Warp Yarn 24 Tex; Weft Yarn 25 Tex; Encs×Picks/10 cm 177×177; Plain Weave)) was prepared. The front structure comprised 125 μm flexible polyimide aerogel (AeroZero 125 micrometer film from BlueShift Inc (US)) layered with a 20 μm layer of a polyurethane (PX60; Xencast UK) (i.e. 25 layers of aerogel alternating with 25 layers of polyurethane). Thus, the laminate had the following arrangement of layers "polyurethane layer/aerogel layer/polyurethane layer/aerogel layer . . . polyurethane layer/aerogel layer/UHMWPE layer/UHMWPE layer . . . UHMWPE layer/UHMWPE layer".

Example 13

A composite structure comprising of 4 individual sets of sub-structures layered on top of one another was prepared, each sub-structure comprising 9 layers of UHMWPE fibre (DOYENTRONTEX Bulletproof unidirectional sheet; WB-674; 160 g/m$^2$; 0.21 mm thickness) on top of 9 layers of 125 μm flexible polyimide aerogel (AeroZero 125 micrometer film from BlueShift Inc (US)) layered with a graphene layer. The graphene layer was formed by the inking method described above in respect of Example 6. Thus, the composite had the following arrangement of layers " . . . UHMWPE layer/UHMWPE layer/UHMWPE layer/graphene layer/aerogel layer/graphene layer/aerogel layer/graphene layer/aerogel layer . . . ". Each sub-structure was then provided with a bottom UHMWPE fibre layer and bonded around its edges with UHMWPE thread to form discrete sub-structures.

The composite structure also comprised a crocheted swatch of 1.0 mm UHMWPE braided thread (see FIG. 9 and accompanying description) with UHMWPE thread whipping around the tile edges to improve performance. The crocheted swatch was placed on top of the composite structure. The structure can be seen in FIGS. 12*a* and 12*b*.

Comparative Example 1

An existing commercially available laminate structure widely used in stab-resistance worn articles was selected as a comparison for the embodiments described above. The comparative example comprises a laminate structure comprising: 12 layers of Kevlar fabric/finely stitched felt/a layer of chainmail/finely stitched felt/12 layers of Kevlar fabric. The laminate structures of Examples 1 and 2 were tested together with the comparative Example.

Comparative Example 2

It was apparent through observations and testing that a significant portion of the force of any impact in the structure of Comparative Example 1 was being dispersed in the plane of the layers by the chainmail layer and so the laminate structure of Comparative Example 1 was also tested with the chainmail removed. Thus, Comparative Example 2 consists of a laminate structure comprising 12 layers of Kevlar fabric/finely stitched felt/12 layers of Kevlar fabric.

Testing

In addition to testing referred to in respect of specific examples mentioned above, further testing was carried out:

Penetration Resistance Testing

Figure 10:
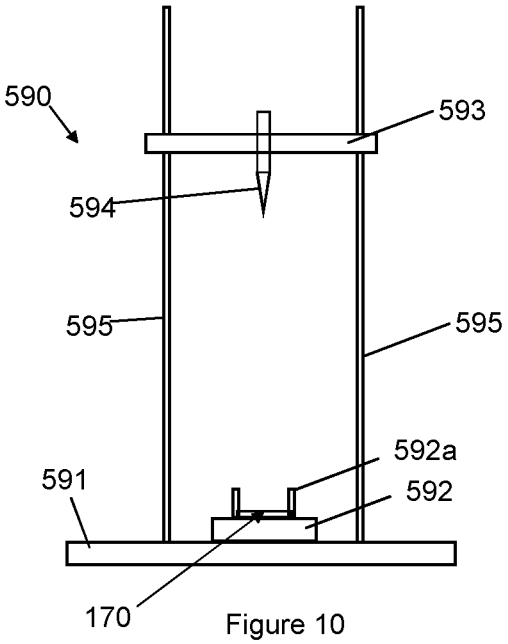
FIG. 10 shows a front view of a test rig.

Testing was carried out using a test rig 590, which is depicted in FIG. 10. The test rig 590 comprises a base 591 on which is provided a jig 592 with clamps 592*a* for mounting a sample (shown as laminate structure 170 in FIG. 10) thereon. The test rig 590 also comprises a weighted sled 593, to which a knife 594 is attached. The test rig 590 is arranged with the weighted sled 593 and knife 594 suspended above the sample, with the blade of the knife 594 facing the sample (i.e. downwards). The sled 593 and knife 594 can then be dropped and travel along vertical guide rails 595 (using a series of linear bearings (not shown) to minimise friction) until the knife 594 impacts the sample. In the test referred to hereinbelow, the test rig used a Home Office Science Development Branch (HOSDB) P1/B Test blade supplied from High Speed and Carbide Limited. In some of the tests, the jig 592 and clamps 593 were not used to restrain the sample used (referred to as "free standing").

The rig was adjusted such that the knife was dropped from a height of 1 m and the total weight of the knife and the weighted sled was 1.75 kg. This created a force on impact of 17.17 Joules and a velocity on impact of 4.43 m/s. In some of the tests set out below, a modelling clay plate was located behind each of the samples to measure the "cut length". The cut length is the length of an indentation from a blade in the clay, which can be present even where the blade does not fully penetrate the fabric and provides an indication of the impact absorbing and penetration resistant properties of the structure. The depth of penetration of the blade into each structure and cut lengths (where measured) are shown below in Table 1:

TABLE 1

| Sample | Jig | Depth Penetration (mm) | Cut Length (mm) |
|---|---|---|---|
| Example 3 | Jig Constrained | 2-6 | — |
| Example 8 | Free standing | <2 | — |
| Example 9 | Jig Constrained | 2-3 | 1.1 |
| Example 10 | Jig Constrained | 2-3 | 0.9 |
| Example 12 | Jig Constrained | 6-7 | 2.7 |
| Comparative Example 1 | Free standing (no jig constraint) | 2-3 | — |
| Comparative Example 1 | Jig Constrained | 2-3 | — |
| Comparative Example 2 | Free standing (no jig constraint) | 39-41 | — |

Table 1 demonstrates that the laminate structures in accordance with an embodiment of the invention provide very high penetration resistance and perform at least as well as the laminate structures used in existing stab-proof vests which include a metal chainmail layer and significantly better than the laminate structures where the metal chainmail layer is removed. Thus, these laminate structures can be used in articles without requiring chainmail or heavy metal plate layers, thereby providing significant advantages. Furthermore, the specific results for Example 2 also show significant protection afforded by a laminate structure with less layers and a thinner structure.

The testing of Example 8 is shown in FIGS. 11*a* and 11*b*. As mentioned above, penetration into the composite structure contained in the UHMWPE outer was less than 2 mm. This is well below the required penetration limits (KR-1 testing) of 7 mm.

Ballistic Testing

Ballistic testing of Examples 4 and 11 was carried out. The tests involved firing a .22 Long Rifle bullet at point-blank range. The composite structures of Examples 4 and 11 were able to stop the .22LR rifle bullet. Examination of the sample after the test showed that the bullets were stopped and held in the composite around the $17^{th}$ layer of UHMWPE and backing structure. Thus, the laminate structures provide effective ballistic protection.

Ballistic testing of Example 13 was also carried out. This was carried out using a high powered .22 Long Rifle bullet at 250 Joules and the bullet was fired towards the face on which the crocheted layer was provided. The composite structure was able to stop the bullet without penetration, as can be seen in FIGS. 12*a* and 12*b*. FIG. 12*b*, in particular, shows that the bullet did not even penetrate the first substructure (see arrow which shows the indentation).

Other variations to the disclosed embodiments can be understood and effected by those skilled in the art in practicing the claimed invention, from a study of the drawings, the disclosure, and the appended claims. For example:

although in the above embodiments, the shields have generally cuboidal shapes with planar surfaces, it will be appreciated that the shape of the shields can be varied and can include circular prisms (e.g. cylinders, with the upper and lower faces defining strike faces), any other polygonal prism and the other shapes mentioned herein; and although the connector arrangements in the above embodiments have hook and loop or adhesive attachment means, any other attachment means can be used, including connectable clips or buttons, zips, magnets, and ties, for example.

The invention claimed is:

1. A protective shield comprising:

a body for protecting a user from a projectile or impact, the body comprising a front strike face and an opposing rear face; and a connector arrangement provided on the body adapted so as to allow the shield to connect to an adjacent protective shield, wherein the strike face has a perimeter defined by edges of the strike face;

wherein the connector arrangement is arranged so that an adjacent protective shield can be connected to the connector arrangement with the body of the adjacent protective shield abutting and/or overlapping with the strike face of the protective shield at any point about the perimeter of the strike face;

wherein the body comprises a composite structure comprising at least one layer comprising graphene and a second layer comprising an aerogel; and wherein the composite structure is arranged between (i) the strike face and rear face, and/or (ii) so as to at least partly define the strike face and/or the rear face.

2. The protective shield of claim 1, wherein the connector arrangement is adapted so that a plurality of adjacent protective shields can be connected to the connector arrangement.

3. The protective shield of claim 1, wherein the connector arrangement comprises first and second connector parts provided on the body, the first connector part being adapted to connect to a second connector part of another protective shield and the second connector part being adapted to connect to a first connector part of another protective shield.

4. The protective shield of claim 3, wherein the first connector part and the second connector part are each provided on the strike face or the rear face; and wherein each extend around the edge of the strike face or rear face on which they are provided.

5. The protective shield of claim 4, wherein at least one of the first and second connector parts is offset from the edge of the face on which they are provided.

6. The protective shield of claim 3, wherein the first connector part is provided on the rear face; and wherein the second connector part is provided on the strike face.

7. The protective shield of claim 3, wherein each of the first and second connector parts comprises a plurality of connector elements.

8. A protective shield comprising:

a body for protecting a user from a projectile or impact, the body comprising a front strike face and an opposing rear face; and a connector arrangement provided on the body adapted so as to allow the shield to connect to an adjacent protective shield, wherein the body comprises a composite structure comprising at least one layer comprising graphene and a second layer comprising an aerogel, and wherein the composite structure is arranged:

(i) between the strike face and rear face; and/or (ii) so as to at least partly define the strike face and/or the rear face.

9. The protective shield of claim 8, wherein the layer comprising graphene comprises graphene in the form of graphene platelets.

10. The protective shield of claim 8, wherein the composite structure comprises a plurality of first layers each comprising graphene; and a plurality of second layers each comprising an aerogel, wherein the first and second layers alternate in the composite structure.

11. The protective shield of claim 8, wherein a fastening element or means is provided to secure the first and second layers of the composite structure together, the fastening element or means being provided along an edge of the composite structure.

12. The protective shield of claim 8, wherein the composite structure further comprises a protective layer selected from the group consisting of aramid fibres, aromatic polyamide fibres, boron fibres, ultra-high molecular weight polyethylene, poly(p-phenylene-2,6-benzobisoxazole) (PBO) or combinations thereof.

13. The protective shield of claim 12, wherein the composite structure is arranged with the protective layer adjacent or defining the strike face.

14. The protective shield of claim 8, wherein the connector arrangement is arranged so that an adjacent protective shield can be connected to the connector arrangement with the body of the adjacent protective shield abutting and/or overlapping with the strike face of the protective shield at any point about the perimeter of the strike face.

* * * * *